US008035596B2

(12) United States Patent
Sekine

(10) Patent No.: US 8,035,596 B2
(45) Date of Patent: Oct. 11, 2011

(54) LIQUID CRYSTAL DISPLAY DEVICE

(75) Inventor: Hiroyuki Sekine, Kanagawa (JP)

(73) Assignee: NEC LCD Technologies, Ltd, Kanagawa (JP)

( * ) Notice: Subject to any disclaimer, the term of this patent is extended or adjusted under 35 U.S.C. 154(b) by 739 days.

(21) Appl. No.: 12/169,197

(22) Filed: Jul. 8, 2008

(65) Prior Publication Data

US 2009/0015744 A1 Jan. 15, 2009

(30) Foreign Application Priority Data

Jul. 9, 2007 (JP) ..... 2007-179823
Jun. 16, 2008 (JP) ..... 2008-156741

(51) Int. Cl.
*G09G 3/36* (2006.01)

(52) U.S. Cl. ..... 345/92; 345/90; 349/39; 349/42

(58) Field of Classification Search ..... 345/87–104; 349/39, 42–45, 87–103, 139, 204
See application file for complete search history.

(56) References Cited

U.S. PATENT DOCUMENTS 7,847,593 B2 * 12/2010 Yoshida ..... 326/83
2007/0164967 A1 * 7/2007 Osame ..... 345/98

FOREIGN PATENT DOCUMENTS

JP 08213627 8/1996
JP 2000010072 1/2000
JP 2006189473 7/2006
JP 2007052088 3/2007

* cited by examiner

*Primary Examiner* — Lun-Yi Lao
*Assistant Examiner* — Insa Sadio
(74) *Attorney, Agent, or Firm* — Sughrue Mion, PLLC

(57) ABSTRACT

To provide a pixel matrix and the like, which are capable of improving the picture quality by suppressing generation of flicker and crosstalk without deteriorating the numerical aperture of the pixels and without increasing the manufacturing cost. A first switch device has transistors connected in series. When selected by a gate line, the transistors are set ON simultaneously to apply a voltage, which is supplied from a data line, to a pixel electrode. A second switch device has a transistor and a control capacitor. When selected by a gate line different from the one mentioned above, the transistor is set ON to supply a prescribed potential to a connection point between the transistors of the first switch, and the prescribed potential is stored at the control capacitor. When not selected by the both gate lines, the potential of the connection point is kept to the potential stored at the control capacitor.

15 Claims, 23 Drawing Sheets

LIQUID CRYSTAL DISPLAY DEVICE

CROSS-REFERENCE TO RELATED APPLICATION

This application is based upon and claims the benefit of priority from Japanese patent application No. 2007-179823, filed on Jul. 9, 2007, and No. 2008-156741, filed on Jun. 16, 2008, the disclosure of which is incorporated herein in its entirety by reference.

BACKGROUND OF THE INVENTION

1. Field of the Invention

The present invention relates to a liquid crystal display device.

2. Description of the Related Art

Active-matrix type liquid crystal display device including transistors as active elements provided at each pixel are capable of displaying high-definition and high-quality images, so that those are used often for display devices of liquid crystal television sets, portable devices, and the like. Among those active-matrix type liquid crystal display devices, those using polycrystalline thin film transistors (referred to as "poly-Si TFT" hereinafter) for the transistors are used especially for liquid crystal display devices of small pixel size, because of the following reasons. That is: with such type, the transistors have high current drive capability, so that the size of the transistor to be provided to each pixel can be reduced; a circuit for generating signals to be supplied to each pixel can be fabricated on a same substrate where each pixel is formed; etc.

FIG. 22 is a circuit block diagram showing an equivalent circuit for one pixel of a liquid crystal display device using poly-Si TFT. Explanations will be provided hereinafter by referring to this drawing.

In the drawing, a transistor Tr1 is provided to each pixel. A pixel capacitor Cpix connected to a source electrode of the transistor Tr1 is formed by a pixel electrode, a counter electrode, and a liquid crystal layer sandwiched therebetween. Further, a holding capacitor Cst is connected to the source electrode of the transistor Tr1. A gate electrode of the transistor Tr1 is connected to a gate line Gn, and a drain electrode of the transistor Tr1 is connected to a data line Dm.

In a period for displaying an image for one screen of the liquid crystal display device, the transistor Tr1 operates to keep video signals that are written to the pixel capacitor Cpix and the holding capacitor Cst in most of that period. It is possible to obtain a fine picture quality with less flicker and crosstalk, if voltages of the pixel capacitor Cpix and the holding capacitor Cst do not fluctuate during that holding period.

Recently, there has been a strong demand on the market for achieving performances such as high definition and high luminance in the display devices. Accordingly, pixel pitches of the liquid crystal display devices have become smaller, and the luminance of the backlights as light sources has been increased. The luminance of the liquid crystal display device depends almost on the luminance of the backlight and the transmittance of the pixels of the liquid crystal display device, and the transmittance of the pixels change greatly according to the numerical aperture. When the pixel pitch becomes smaller because of achieving high definition, the numerical aperture naturally becomes smaller as well. In addition, values of the pixel capacitor and the holding capacitor also become smaller. Further, leak currents of the transistors are increased depending on the amount of light to be irradiated to the transistors. Therefore, in the high-definition and high-luminance liquid crystal display device, the voltages of the pixel capacitor and the holding capacitor become fluctuated during the holding period, thereby generating flicker and crosstalk.

Especially, in a case of a liquid crystal display device using a top-gate type poly-Si TFT, the light from the backlight is irradiated directly to the channel part of the transistor. Thus, a light leak current thereof becomes larger than that of a liquid crystal display device using an amorphous silicon thin film transistor (referred to as "a-Si TFT" hereinafter) which is typically a bottom-gate type. This results in having more serious issues.

Further, crosstalk is largely affected not only by the extent of the leak current of the transistor but also by "dependency of the leak current on a voltage Vds between the source and the drain". Furthermore, provided that a potential of the data line Dm is Vdata and a voltage of the pixel capacitor Cpix is Vpix, Vds is a function of Vdata and Vpix. Thus, the voltage between the source and drain of the transistors of each pixel fluctuates largely depending on the luminance of a signal written to each pixel that is connected to the common data line. Therefore, the leak current of the transistors is to change largely. As a result, when a specific pattern is displayed, pixels that are not displaying the pattern are to be affected, thereby generating crosstalk.

Japanese Unexamined Patent Publication 2000-010072 (FIG. 1, etc.: Patent Document 1) discloses an example of a traditional technique for dealing with such issues. FIG. 23A is a circuit diagram showing an equivalent circuit for one pixel of a liquid crystal display device that is disclosed in Patent Document 1. Explanations will be provided hereinafter by referring to the drawing.

In this technique, transistors for writing video signals to the pixel are two transistors Tr1 and Tr2 which are connected in series. After completing writing of the video signal to the pixel, the two transistors Tr1 and Tr2 are set to be nonconductive simultaneously, and an intermediate node that is a connection point between the two transistors Tr1 and Tr2 is connected via a third transistor Tr3*p* to a common wiring ST having a voltage that is equivalent to that of a counter electrode. With these operations, out of the two transistors Tr1 and Tr2 which are connected in series, the voltage Vds between the source and drain of the transistor Tr2 that is connected to the pixel becomes irrelevant to the potential of the data line Dm. It is considered therefore to be able to reduce the crosstalk.

Japanese Unexamined Patent Publication 2006-189473 (FIG. 2, etc.: Patent document 2) discloses another example of the traditional technique mentioned above. FIG. 23B is a circuit diagram showing an equivalent circuit for one pixel of a liquid crystal display device disclosed in Patent document 2. Explanation will be provided hereinafter by referring to the drawing.

As in the case of the technique disclosed in Patent Document 1, the transistors for writing a video signal to the pixel are the two transistors Tr1 and Tr2 which are connected in series. It is a method which, after setting the two transistors Tr1 and Tr2 to be nonconductive, connects the intermediate node that is a connection point between the two transistors Tr1 and Tr2 to a common wiring ST having a voltage that is close to the potential of the counter electrode via a third transistor Tr3. With this, out of the two transistors Tr1 and Tr2 which are connected in series, the voltage Vds between the source and drain of the transistor Tr2 that is connected to the pixel becomes irrelevant to the potential of the data line Dm. It is considered therefore to be able to reduce the crosstalk.

The liquid crystal display devices disclosed in Patent Documents 1 and 2 are described by simplifying a part thereof, in order to make clear the differences with respect to the present invention.

However, there are following issues with those traditional techniques.

The first issue is that the manufacturing cost becomes high. With the technique depicted in Patent Document 1, it becomes necessary for the conduction type of the two transistors Tr1, Tr2 connected in series for writing the video signal to the pixels to be different from the conduction type of the third transistor Tr3*p* for supplying a potential to the intermediate node that is the connection point of the two transistors Tr1 and Tr2. In Patent Document 1, illustrated is a case where the transistors Tr1, Tr2 are n-channel transistors, and the transistor Tr3*p* is a p-channel transistor. By using the transistors of different conduction types as in this case, it is possible to have a control line (gate line Gn) that is connected to the gate electrodes of the transistors Tr1, Tr2 and a control line (gate line Gn) that is connected to the gate electrode of the transistor Tr3*p* to be a common line, which makes it possible to control one of the transistors to be conductive and the other to be nonconductive at the same time. With this, it becomes unnecessary to use different control lines for both transistors separately. This is advantageous in terms of improving the numerical aperture of the pixels. However, this requires a process for fabricating the n-channel transistors and p-channel transistors, so that the manufacturing cost is increased.

The second issue is that the numerical aperture becomes deteriorated. With the technique depicted in Patent Document 2, it is possible for the conduction types of all the transistors Tr1-Tr3 used in the pixel to be the same. Thus, the manufacturing cost is not increased. However, it is necessary to control the gate electrodes of the two transistors Tr1 and Tr2 which are connected in series and the gate electrode of the third transistor Tr3 by different control lines. That is, it becomes necessary to provide an additional control line Con for each pixel row for controlling the third transistors Tr3, which results in deteriorating the numerical aperture.

SUMMARY OF THE INVENTION

In view of the foregoing issues, it is therefore an exemplary object of the invention to provide a liquid crystal display device which can improve the picture quality by suppressing generation of flicker and crosstalk without deteriorating the numerical aperture of the pixels and without increasing the manufacturing cost.

A liquid crystal display device according to an exemplary aspect of the invention is a pixel display device including a pixel matrix configured with pixels, each having pixel electrode, which are provided near intersection points of a plurality of gate lines and a plurality of data lines, wherein each of the pixels includes: a first switch device having a plurality of transistors A connected in series, which applies a voltage supplied from one of the plurality of data lines to pixel electrode when the plurality of transistors A are set ON simultaneously, when selected by a first gate line that is one of the plurality of gate lines; and a second switch device having a transistor B and a capacitor, which: supplies a prescribed potential at least to one of connection points between the plurality of transistors A and stores the prescribed potential at the capacitor when the transistor B is set ON, when selected by a second gate line that is one of the plurality of gate lines but different from the first gate line; and keeps at least one of potentials of the connection points of the plurality of transistors A to the potential stored at the capacitor, when not selected by the first gate line and the second gate line.

A liquid crystal display device according to another exemplary aspect of the invention is a liquid crystal display device including a pixel matrix configured with pixels, each having pixel electrode, which are provided near intersection points of a plurality of gate lines and a plurality of data lines, wherein: each of the pixels includes a first switch device having a plurality of transistors A connected in series, which applies a voltage supplied from one of the plurality of data lines to pixel electrode when the plurality of transistors A are set ON simultaneously when selected by a first gate line that is one of the plurality of gate lines; and two neighboring pixels as a pair on the pixel matrix include at least one transistor B having its source electrode and drain electrode connected between at least one of connection points of the plurality of transistors A of one pixel and another connection point or at least one connection point of the plurality of transistors A of a plurality of pixels and having its gate electrode connected to a second gate line that is one of the plurality of gate lines but different from the first gate line, and include a plurality of capacitors having their one ends connected to each of the connection points of the plurality of transistors A of each of the pixels that are connected to the transistor B and having the other ends connected to a common electrode.

DETAILED DESCRIPTION OF THE EXEMPLARY EMBODIMENTS

Exemplary embodiments of the invention will be described hereinafter by referring to the accompanying drawings.

First Exemplary Embodiment

Figure 1:
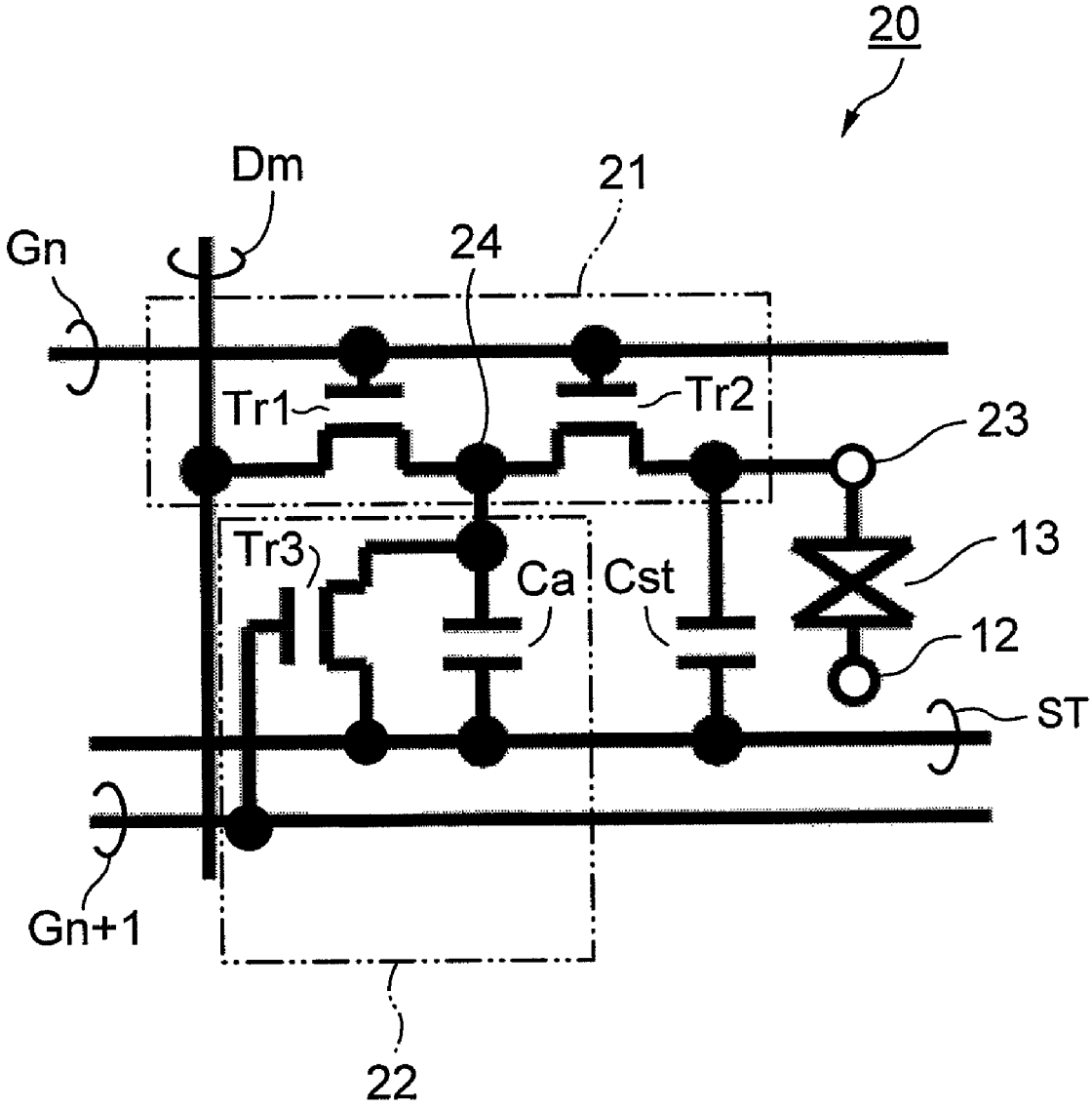
FIG. 1 is a circuit block diagram showing a first exemplary embodiment of a pixel matrix and a liquid crystal display device according to the invention, which shows an equivalent circuit for one pixel.
Figure 2:
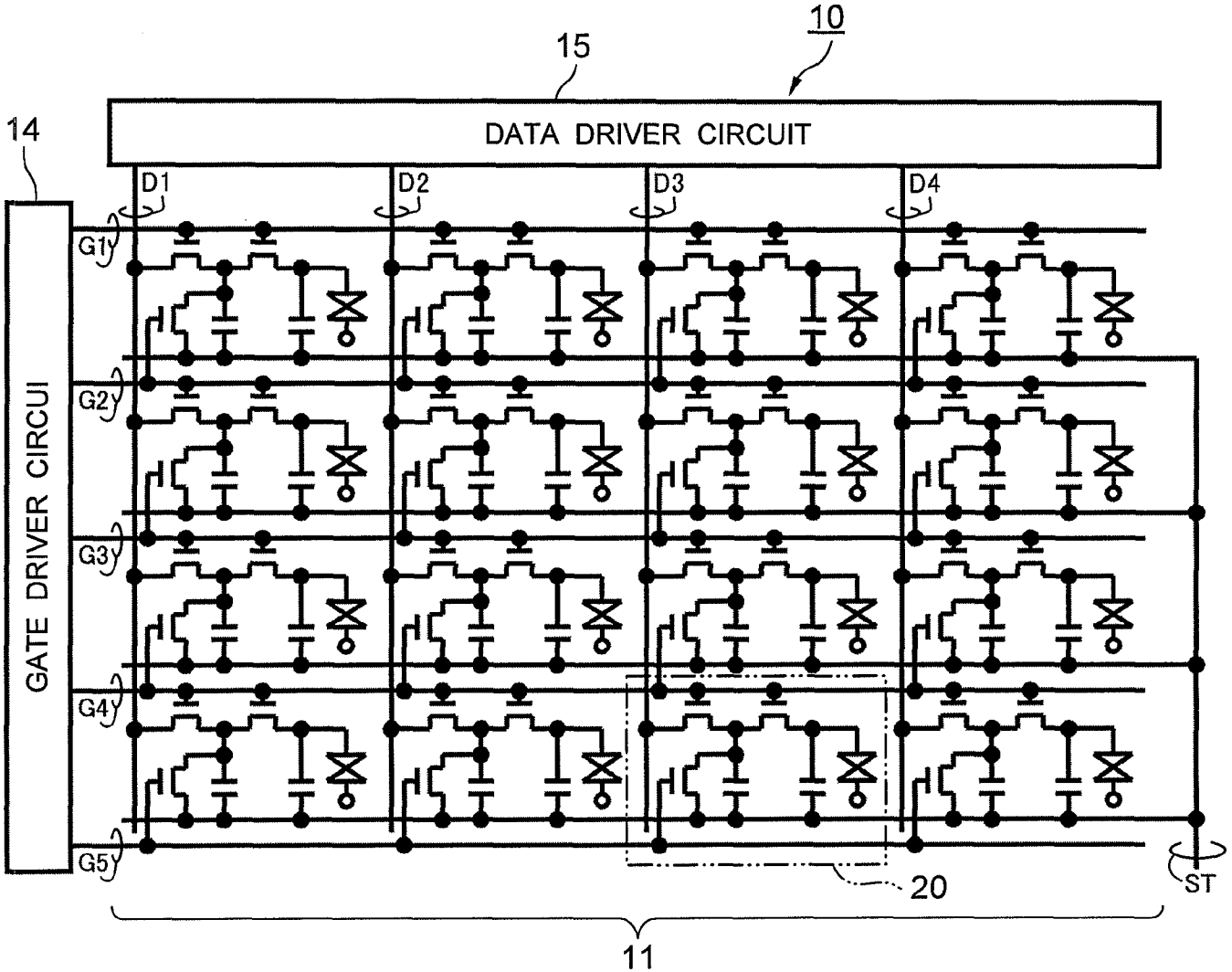
FIG. 2 is a circuit block diagram showing the first exemplary embodiment of the pixel matrix and the liquid crystal display device according to the invention, which shows the entire equivalent circuits.

FIG. 1 and FIG. 2 are circuit block diagrams showing a first exemplary embodiment of a liquid crystal display device having a pixel matrix according to the invention. FIG. 1 shows an equivalent circuit for one pixel, and FIG. 2 shows the entire equivalent circuits. Explanations will be provided hereinafter by referring to those drawings.

A pixel 20 of FIG. 1 represents an arbitrary one pixel taken out from a pixel matrix 11 of FIG. 2. Thus, reference numerals for its gate line and data line are generalized as "n" and "m" in FIG. 1. The pixel matrix 11 is configured with the pixels 20 each having a pixel electrode 23 being arranged near the intersection points between gate lines G1-G4 and data lines D1-D4. Each pixel 20 includes a switch device 21 as a first switch device, and a switch device 22 as a second switch device. The switch device 21 has transistors Tr1, Tr2 as a plurality of transistors A connected in series. When selected by a gate line Gn that is one of the gate lines G1-G4, the transistors Tr1 and Tr2 are set ON simultaneously to apply a voltage, which is supplied from a data line Dm that is one of the data lines D1-D4, to the pixel electrode 23. The switch device 22 has a transistor Tr3 as a transistor B and a control capacitor Ca as a capacitor. When selected by a gate line Gn+1 that is one of the gate lines G1-G4 but different from the gate line Gn, the transistor Tr3 is set ON to supply a prescribed potential to a connection point 24 between the transistors Tr1 and Tr2, and the prescribed potential is stored at the control capacitor Ca. When not selected by the gate line Gn and the gate line G+1, the potential of the connection point 24 is kept to the potential stored at the control capacitor Ca.

Further, each pixel 20 has a common wiring ST as a common electrode to which a prescribed potential is applied. The transistor Tr3 is set ON when it is selected by the gate line Gn+1, thereby connecting the common wiring ST to the control capacitor Ca to supply the prescribed potential to the control capacitor Ca.

Further, in the switching device 21, the gate electrodes of the transistors Tr1 and Tr2 are connected in common to the gate line Gn, the source electrode of the transistor Tr1 is connected to the drain electrode of the transistor Tr2, the drain electrode of the transistor Tr1 is connected to the data line Dm, and the source electrode of the transistor Tr2 is connected to the pixel electrode 23. In the switch device 22, the control capacitor Ca is connected between the connection point 24 of the transistors Tr1, Tr2 and the common wiring ST, the gate electrode of the transistor Tr3 is connected to the gate line Gn+1, the source electrode of the transistor Tr3 is connected to the connection point 24, and the drain electrode of the transistor Tr3 is connected to the common wiring ST.

A liquid crystal display device 10 according to this exemplary embodiment includes a transistor substrate on which the pixel matrix 11 is disposed, and a counter substrate that is arranged to face the transistor substrate with a liquid crystal layer 13 interposed therebetween. The transistor substrate is also referred to as a TFT substrate, and it is configured by forming the pixel matrix 11, a gate driver circuit 14, a data driver circuit 15, and the like on a glass substrate, for example. The counter substrate is configured by forming a counter electrode 12 and the like on a glass substrate, for example.

The structure excluding the counter electrode 12, the liquid crystal layer 13, the gate driver circuit 14, and the data driver circuit 15 from the liquid crystal display device 10 is referred to as the pixel matrix 11 hereinafter. Further, the liquid crystal layer 13 for one pixel configures a pixel capacitor Cpix, and a holding capacitor Cst is connected between the source electrode of the transistor Tr2 and the common wiring ST. The holding capacitor Cst may be omitted depending on the circumstances.

Next, operations and effects of this exemplary embodiment will be described. With the pixel matrix 11 and the liquid crystal display device 10 of this exemplary embodiment, when selected by the gate line Gn, the transistors Tr1 and Tr2 are set ON simultaneously to apply the voltage, which is supplied from the data line Dm, to the pixel electrode 23. When selected by the gate line Gn+1, the transistor Tr3 is set ON to supply the prescribed potential to the connection point 24 between the transistors Tr1, Tr2, and the prescribed potential is stored at the control capacitor Ca. When not selected by the gate lines Gn and Gn+1, the transistors Tr1-Tr3 are set OFF, and the potential of the connection point 24 is kept to the potential that is stored at the control capacitor Ca. With this, when not selected by the gate line Gn, the voltage of the connection point 24 can be stabilized. Thus, the leak current of the transistor Tr2 can be reduced. This makes it possible to stabilize the voltage of the pixel electrode 23, so that flicker and crosstalk can be suppressed. Note here that the fact the transistors Tr1-Tr3 are set ON by selection signals of the gate lines Gn and Gn+1 means the transistors Tr1-Tr3 are of a same conduction type. Thus, the manufacturing processes can be simplified compared to the case of manufacturing the transistors of different conduction types, so that the manufacturing cost can be suppressed. Further, the gate line Gn+1 for driving the transistor Tr3 is a wiring for driving the transistors Tr1, Tr2 of another pixel. Thus, there is no special wiring required for driving the transistor Tr3. Therefore, it is possible to improve the numerical aperture of the pixel 20 compared to the case that requires a special wiring. That is, it is possible with the present invention to obtain the pixel matrix 11 and the like, which are capable of improving the picture quality by suppressing generation of flicker and crosstalk without deteriorating the numerical aperture of the pixel 20 and without increasing the manufacturing cost.

The source and drain of each of the transistors Tr1-Tr3 have the same structure, so that those can be called inversely. Needless to say, "connection" herein means electrical connection. "Prescribed potential" is not limited to the voltage of the common electrode but may also be a voltage that does not depend on the data line, e.g., a constant DC voltage, a voltage with smaller fluctuation than the voltage of the data line (that is, stable voltage). These also apply to exemplary embodiments described hereinafter.

Hereinafter, the pixel matrix 11 and the liquid crystal display device 10 according to the first exemplary embodiment will be described in more detail.

FIG. 2 shows the structure of the liquid crystal device 10 of the exemplary embodiment. FIG. 1 shows an arbitrary pixel 20 taken out from that. The liquid crystal display device 10 is configured with: the pixel matrix 11 on which pixels are arranged in matrix in the vicinity of each intersection point between the data lines (D1-D4) and the gate lines (G1-G4) provided in lengthwise and widthwise directions; the data driver circuit 15 for driving the data lines; and the gate driver 14 for driving the gate lines. Each pixel of the pixel matrix 11 is configured with: the two transistors Tr1, Tr2 arranged in series (having one end connected to the data line and the other end connected to the pixel capacitor Cpix and the holding capacitor Cst); the pixel capacitor Cpix connected to Tr2; the holding capacitor Cst; the control capacitor Ca connected to the connection point between the Tr1 and Tr2; and the transistor Tr3 that is arranged in parallel to control capacitors Ca. The other end of the holding capacitor Cst and the other end of the control capacitor Ca are connected to the wiring ST that is used in common to the whole pixels. Each pixel capacitor Cpix is a capacitor that is configured with a pixel electrode on the TFT substrate having the transistors formed on the surface and, although not shown, the counter electrode 12 of the counter substrate which opposes to the TFT substrate with the liquid crystal layer 13 interposed therebetween. Further, the number of output terminals of the gate driver circuit 14 is larger at least by one than the number of pixel rows of effective pixels that contribute to the display of the pixel matrix 11, and the terminals thereof are connected to a gate line G5 arranged along the edge part of the effective pixels of the pixel matrix 11. The gate terminals of Tr1 and Tr2 are connected to a common gate line, and the gate terminal of Tr3 is connected to a gate line that is one of two neighboring gate lines, which is different from the gate line connected to Tr1 and Tr2.

In FIG. 2, there are four data lines and four gate lines that are connected to the effective pixels. However, the number of those lines is not limited to such numerical value. Further, the data driver circuit 15 and the gate driver circuit 14 may be formed by a same process on the substrate where the pixel transistors are formed, or one of the circuits or the both circuits may be formed on another substrate and electrically connected to the transistors.

Figure 3:
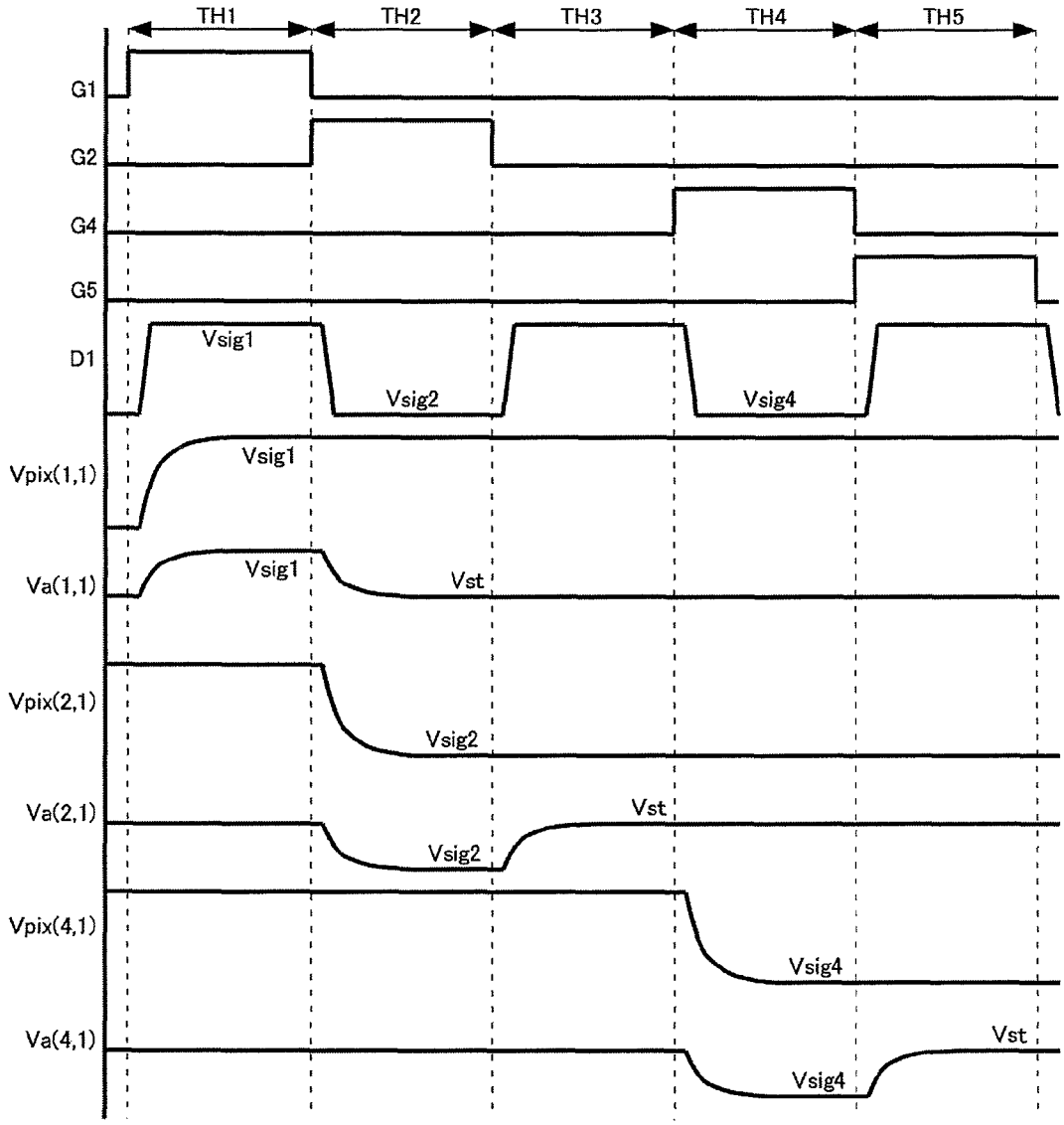
FIG. 3 is a timing chart showing operations of the pixel matrix and the liquid crystal display device shown in FIG. 1 and FIG. 2.

Next, the actions will be described by referring to a timing chart shown in FIG. 3. This timing chart shows changes in the control signal line, the pixel voltage, and the like in a period where the video signals are written to a plurality of pixel rows of the liquid crystal display device according to the exemplary embodiment. Each of periods TH1-TH4 indicates one horizontal period for writing a video signal for one pixel row. G1-G5 are voltage waveforms of the gate lines G1-G5, respectively, and D1 is a voltage waveform of the data line D1. "Vpix (1, 1)" shows a pixel electrode potential (pixel capacitor potential) of the pixel connected to the gate line G1 and the data line D1, and Va (1, 1) shows a voltage of the control capacitor Ca of that pixel. Similarly, "Vpix (2, 1)" shows a pixel electrode potential of the pixel connected to the gate line G2 and the data line D1, and Va (2, 1) shows a voltage of the control capacitor Ca of that pixel.

In the period TH1, the pixel transistors Tr1 and Tr2 are set to an ON-state when the potential of the gate line G1 changes to a voltage that makes Tr1, Tr2 electrically conductive. With this, a potential Vsig1 of the data line D1 is written to the pixel capacitor Cpix and the holding capacitor Cst. Note here that Vsig1 is a voltage corresponding to the video signal to be displayed on the pixel. Simultaneously with this, the same voltage Vsig1 is also written to the control capacitor Ca. At this time, the gate terminal of Tr3 is connected to the gate line G2, so that it is in an OFF-state. Then, when the potential of G1 changes to a potential that makes the pixel transistors Tr1, Tr2 nonconductive, all of the transistors Tr1, Tr2, Tr3 come to be in an OFF-state. The similar operations are executed at each of the pixels connected to the data lines D2-D4 and the gate line G1, and the video signal for one pixel row is written to the pixel capacitor Cpix and the holding capacitor Cst.

Then, in the period TH2, the gate line G2 changes to a potential that makes the pixel transistor electrically conductive, so that Tr3 of each pixel connected to the gate line G1 is changed to be in an ON-state. Thus, Vst as the potential of the wiring ST is written to the control capacitor Ca. After the gate line G2 changes to a potential that changes the transistor to be in an OFF-state, Vst is kept therein. Simultaneously with this, the video signal is written to the pixel capacitors Cpix and the holding capacitors Cst of each pixel that is connected to the gate line G2, by the same operations as those described above.

The period TH4 is a period where the video signal is written to each pixel that is connected to the gate line G4 to which the video signal is written lastly among the effective pixels. The operations for writing the video signal to the pixel capacitors Cpix and the holding capacitors Cst of each pixel that is connected to the gate line G4 is the same operations as those described above. At the end of the period TH4, the video signal for displaying the video at each pixel is being written to the pixel capacitor Cpix, the holding capacitor Cst, and the control capacitor Ca of each pixel that is connected to the gate line G4.

Next, in the period TH5, the gate line G5 changes to a potential that makes the pixel transistor electrically conductive, so that Tr3 of each pixel connected to the gate line G4 is changed to be in an ON-state. With this, Vst as the potential of the wiring ST is written to the control capacitors Ca of each pixel that is connected to the gate line G4.

By a series of these operations, the video signal is written to each of the whole pixel capacitors Cpix and holding capacitors Cst of the effective pixels. Thus, the voltage Vst of the wiring ST is written and held to the control capacitors Ca in the period where each pixel is in a video signal holding operation (operation under a state where the pixel transistors Tr1 and Tr2 of each pixel are in an OFF-state). Note here that Vst is in a value that is almost equivalent to the voltage of the counter electrode.

While the pixel transistors Tr1, Tr2, and Tr3 are n-type transistors in the case that has been described heretofore, it is also possible to use p-type transistors. In that case, the potential of each gate line may simply be changed to in a state for allowing the p-type to be conductive and nonconductive. Further, regarding channel widths W1-W3 of Tr1, Tr2, and Tr3 (FIG. 11), the channel width W3 of Tr3 may be set smaller than the channel widths W1, W2 of Tr1, Tr2. The reason is that it is sufficient for Tr3 to have a characteristic for writing the control capacitor Ca, and the value of Ca may be a value that is smaller than the total of the pixel capacitor Cpix and the holding capacitor Cst. Further, there has been described a case of dot inversion or gate line inversion where the polarities of the video signal, which is written to the two pixels that are adjacent vertically and are connected to the same data line, for the counter electrode are inverted, in one frame period for displaying video signal of one screen with the liquid crystal display device. However, it is also possible to be data line inversion or frame inversion with which the polarities become identical. Further, it is also possible to have an operation which divides the pixels connected to the same gate line in one horizontal period into a plurality of blocks, and writes the video signal to a block unit in a time division manner.

With the liquid crystal display device according to the present invention, fluctuation of the voltage in the holding period of the pixel capacitor Cpix and the holding capacitor Cst can be suppressed to be small. Thus, it is possible to reduce flicker and crosstalk greatly. Further, the structure of the present invention can be achieved by a method with a low process cost. Furthermore, the numerical aperture is not to be deteriorated largely with the structure of the present invention. The reasons for that will be described hereinafter.

When dot inversion or gate line inversion is used among the method for AC driving the liquid crystal, in almost half the period from the point where a video signal is written to the pixel capacitors Cpix and the holding capacitors Cst of each pixel to the point where a next video signal is written thereto, a video signal having different polarity for the counter electrode with respect to the polarity of the video signal written to the corresponding pixel is written to the data line which is connected to that pixel. However, in the liquid crystal display device according to the present invention, the control capacitor Ca is provided to the connection point of the pixel transistors Tr1, Tr2, and Vst that is the potential of the wiring ST which is irrelevant to the data line potential is written to the control capacitor Ca in most of the period where Tr1 and Tr2 are in the holding operation. Therefore, the source-drain voltage Vds of the transistor Tr2 connected to the pixel capacitor Cpix and the holding capacitor Cst comes to have a potential difference of Vst with respect to the voltage that is written to the pixel capacitor Cpix and the holding capacitor Cst. Since Vst is a voltage that is almost equivalent to the counter electrode potential, Vds of Tr2 becomes about a half at the most with respect to the voltage that is applied to the data line. A leak current of the transistor depends on Vds, and the leak current becomes increased as Vds becomes larger. Thus, to reduce Vds is equivalent to reducing the leak current. Therefore, flicker and crosstalk can be reduced. Further, the crosstalk are generated because the leak current of the transistor fluctuates depending on the voltage written to the data line in the period where the pixel is in the holding operation. Thus, crosstalk are not generated when the data line potential becomes irrelevant to the source-drain voltage Vds in the holding period as in the case of the present invention.

When data line inversion or frame inversion is used, among each of the pixels of the liquid crystal display device, the influences are different in a pixel to which a video signal is written at an early stage of one frame and in a pixel to which the video signal is written at the last stage. In the case of the pixel to which the video signal is written at the early stage, the polarity of the video signal written to the pixel for the counter electrode is the same as the polarity of the signal applied to the data line for the counter electrode in most of the frame period. Meanwhile, in the case of the pixel to which the video signal is written at the last stage, the polarity of the video signal written to the pixel for the counter electrode is different from the polarity of the signal applied to the data line for the counter electrode in most of the frame period. Therefore, in a traditional liquid crystal display device, the source-drain voltage of the pixel transistor is small in the pixel to which the video signal is written at the early stage, and the leak current becomes small as well. In the meantime, the source-drain voltage of the pixel transistor is large in the pixel to which the video signal is written at the last stage, and the leak current becomes large as well. Therefore, flicker and crosstalk become extensive in the pixel to which the video signal is written at the last stage, so that it is difficult to make the flicker uniform within a plane of the liquid crystal display device. In the meantime, with the liquid crystal display device of the present invention, the source-drain voltage Vds of the transistor Tr2 that is connected to the pixel capacitors and the holding capacitors of each pixel becomes irrelevant to the data line potential. Thus, there is no difference between the leak current of the pixel to which the video signal is written at the early stage and the leak current of the pixel to which the video signal is written at the last stage. Therefore, it is possible to reduce the flicker and crosstalk greatly.

Further, since it is possible to configure all the transistors used for the pixels with a same type of transistors. Thus, compared to a case where both p-type and n-type transistors are used, the process cost can be reduced. Further, it is unnecessary to provide any exclusive control lines in each pixel other than the gate lines and data lines for controlling the three transistors Tr1-Tr3. Therefore, deterioration of the numerical aperture can be suppressed to a minimum.

Next, a driving method of the pixel matrix 11 will be described by referring to FIG. 1-FIG. 3. This driving method is an exemplary embodiment of a pixel matrix driving method according to the present invention, and the above-described operations of the pixel matrix 11 will be described as the driving method.

The driving method according to this exemplary embodiment is a method for driving the pixel matrix 11 that is configured with the pixels 20 having the pixel electrode 23, which are arranged in matrix in the vicinity of intersection points between the gate lines G1-G4 and the data lines D1-D4. First, when each pixel 20 having the transistors Tr1-Tr3 connected in series and the control capacitor Ca is selected by the gate line Gm that is one of the gate liens G1-G4, the transistors Tr1, Tr2 are set ON simultaneously to apply the voltage supplied from the data line Dm that is one of the data lines D1-D4 to the pixel electrode 23. Subsequently, when selected by the gate line Gn+1, the transistor Tr3 is set ON to supply a prescribed potential to the connection point 24 between the transistors Tr1 and Tr2, and stores the prescribed potential at the control capacitor Ca. Then, when not selected by the gate lines G1 an G2, the transistors Tr1-Tr3 are set OFF, and the potential of the connection point 24 between the transistors Tr1, Tr2 is kept to the potential that is stored at the control capacitor Ca. The driving method of this exemplary embodiment can provide the similar functions and effects as those of the pixel matrix 11 described above.

An exemplary advantage according to the invention is as follows. With the present invention, when selected by the first gate line, the plurality of transistors A are set ON simultaneously to apply the voltage, which is supplied from the data line, to the pixel electrode. When selected by the second gate line, the transistor B is set ON to supply the prescribed potential at least to one of the connection points between the plurality of transistors A, and the prescribed potential is stored at the capacitor. When not selected by the first and second gate lines, the transistors A and the transistor B are set OFF, and the potential of at least one connection points between the plurality of transistors A is kept to the potential that is stored at the capacitor. With this, when not selected by the first gate line, the voltage of the connection points between the plurality of transistors A can be stabilized. Thus, the leak current of the plurality of the transistors A can be reduced. This makes it possible to stabilize the voltage of the pixel electrode, so that flicker and crosstalk can be suppressed. Note here that the fact the transistors A and B are set ON by selection signals of the first and second gate lines means the transistors A and B are of a same conduction type. Thus, the manufacturing processes can be simplified compared to the case of manufacturing the transistors of different conduction types, so that the manufacturing cost can be suppressed. Further, the second gate line for driving the transistor B is a wiring for driving the transistors A of another pixel. Thus, there is no special wiring required for driving the transistor B. Therefore, it is possible to improve the numerical aperture of the pixels compared to the case that requires a special wiring. That is, it is possible with the present invention to obtain the pixel matrix and the like, which are capable of improving the picture quality by suppressing generation of flicker and crosstalk without deteriorating the numerical aperture of the pixels and without increasing the manufacturing cost.

Second Exemplary Embodiment

Figure 4A:
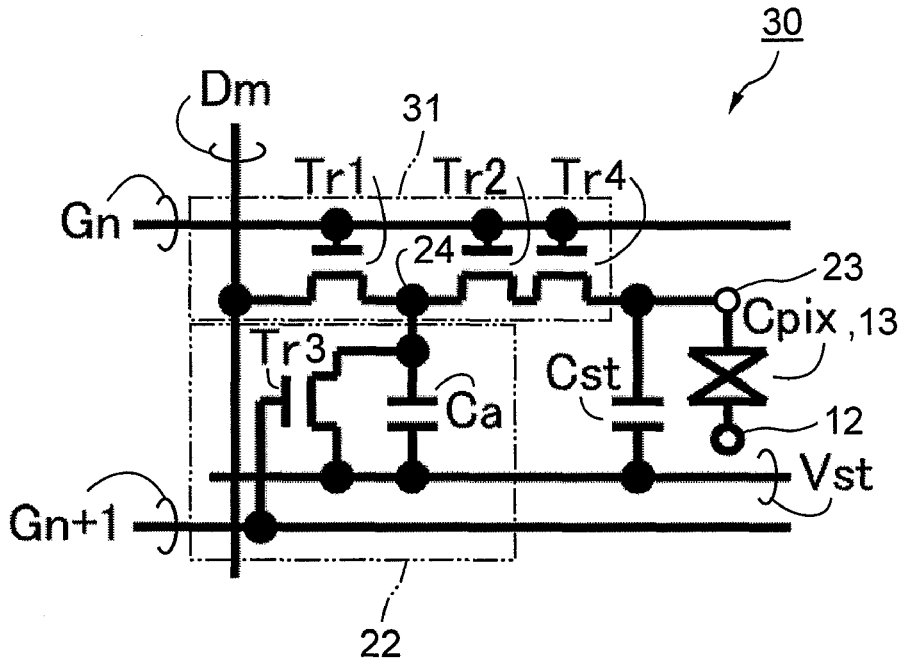
FIG. 4A is a circuit block diagram showing a second exemplary embodiment of the pixel matrix and the liquid crystal display device according to the invention, which shows an equivalent circuit for one pixel.

FIG. 4A is a circuit block diagram showing a second exemplary embodiment of the pixel matrix and the liquid crystal display device according to the present invention, and it is an equivalent circuit for one pixel. Explanation will be provided hereinafter by referring to this drawing. Same reference numerals are applied to the same components as those of FIG. 1, and explanations thereof will be omitted.

The structure of the entire liquid crystal display device according to this exemplary embodiment is the same as the structure that is shown in FIG. 2, except for the inside the pixel. In this exemplary embodiment, a switch device 31 of a pixel 30 is different from the first exemplary embodiment. In the second exemplary embodiment, four pixel transistors are provided to each pixel 30. Among those, the transistors Tr1, Tr2, and Tr4 are connected in series, and Tr1 as one end is connected to a data line Dm, while Tr4 as the other end is connected to a pixel capacitor Cpix and a holding capacitor Cst. Further, gate electrodes of Tr1, Tr2, and Tr4 are connected to a common gate line Gn. A control capacitor Ca and a transistor Tr3 are connected to the connection point of Tr1 and Tr2. The other end of Cst and the other end of Ca are connected to a wiring ST that is used in common for all the pixels. Further, the other end of Tr3 is also connected to the wiring ST, and the gate terminal is connected to a gate line Gn+1 that is an adjacent line to Gn.

That is, in this structure, the pixel transistor Tr2 in the structure of FIG. 1 is formed as a double-gate transistor. Needless to say, the transistor connected to the data line, which corresponds to the pixel transistor Tr1 in the structure of FIG. 1, may also be formed as a double-gate transistor. Further, those transistors may also be formed to have multiple gates, i.e., may be formed as triple-gate transistors. However, when the transistors are formed to have multiple gates, the area for placing the transistors is increased, thereby deteriorating the numerical aperture. Therefore, it is desirable to have only the transistor connected to the pixel capacitor (corresponds to the pixel transistor Tr2 in the structure of FIG. 1) formed with multiple gates. Further, while the case of configuring the pixel transistors with n-type transistors is described herein, it is also possible to use p-type transistors.

The operations of the liquid crystal display device according to the second exemplary embodiment is the same as the operations of the liquid crystal display device shown in FIG. 2. With the liquid crystal display device of the second exemplary embodiment, fluctuation of the voltage in the holding period of the pixel capacitor Cpix and the holding capacitor Cst can be suppressed to be small. Thus, it is possible to reduce flicker and crosstalk greatly. Further, the structure of the exemplary embodiment can be achieved by a method with a low process cost. Furthermore, the structure of the exemplary embodiment can be achieved while suppressing deterioration of the numerical aperture. The reason for this is that the leak current of the transistors Tr2 and Tr4 which are connected to the pixel capacitor can be reduced, which is the same reason as the one described in the first exemplary embodiment. Further, the source-drain voltages of each of the transistors Tr1 and Tr4 can be divided, so that the leak current can be reduced further compared to the case shown in FIG. 1, since the transistors that hold the voltage written to the pixel capacitor are configured with two transistors Tr2 and Tr4 connected in series in this exemplary embodiment.

Third Exemplary Embodiment

Figure 4B:
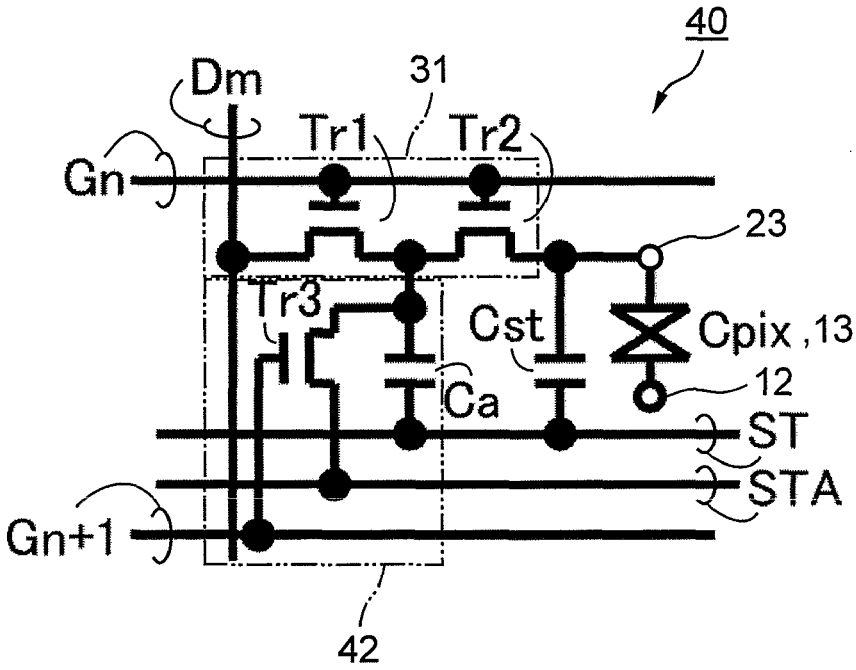
FIG. 4B is a circuit block diagram showing a third exemplary embodiment of the pixel matrix and the liquid crystal display device according to the invention, which shows an equivalent circuit for one pixel.

FIG. 4B is a circuit block diagram showing a third exemplary embodiment of the pixel matrix and the liquid crystal display device according to the present invention, and it is an equivalent circuit for one pixel. Explanation will be provided hereinafter by referring to this drawing. Same reference numerals are applied to the same components as those of FIG. 1, and explanations thereof will be omitted.

The structure of the entire liquid crystal display device according to the third exemplary embodiment is the same as the structure that is shown in FIG. 2, except for the inside the pixel. In this exemplary embodiment, a switch device 42 of a pixel 40 is different from the first exemplary embodiment. In the switch device 42, a transistor Tr3 for writing a signal to the control capacitor Ca is connected to a wiring STA that is different from the wiring ST. Note here that the voltage of the wiring STA is a voltage that is almost equivalent to the potential of a counter electrode 12, as in the case of the wiring ST. That is, it is so formed that the wiring ST and the wiring STA are not to be affected by each other electrically, through connecting those via a buffer circuit, for example. While the case of configuring the pixel transistors with n-type transistors is described herein, it is also possible to use p-type transistors.

The operations of the liquid crystal display device according to the third exemplary embodiment is the same as the operations of the liquid crystal display device shown in FIG. 2. With the liquid crystal display device of the third exemplary embodiment, fluctuation of the voltage in the holding period of the pixel capacitor Cpix and the holding capacitor Cst can be suppressed to be small. Thus, it is possible to reduce flicker and crosstalk greatly. Further, the structure of this exemplary embodiment can be achieved by a method with a low process cost. Furthermore, the structure of the exemplary embodiment can be achieved while suppressing deterioration of the numerical aperture. The reason for this is the same reason as the one described in the first exemplary embodiment. Further, with the structure of this exemplary embodiment, the transistor Tr3 which writes a voltage almost equivalent to the counter electrode potential to a control capacitor Ca is connected to the wiring STA that is different from the wiring ST. Thus, the potential of the wiring ST connected to the holding capacitors of the entire pixels is not fluctuated by the current flown when Tr3 is in an ON-state, so that it becomes possible to reduce the flicker further.

Fourth Exemplary Embodiment

Figure 5:
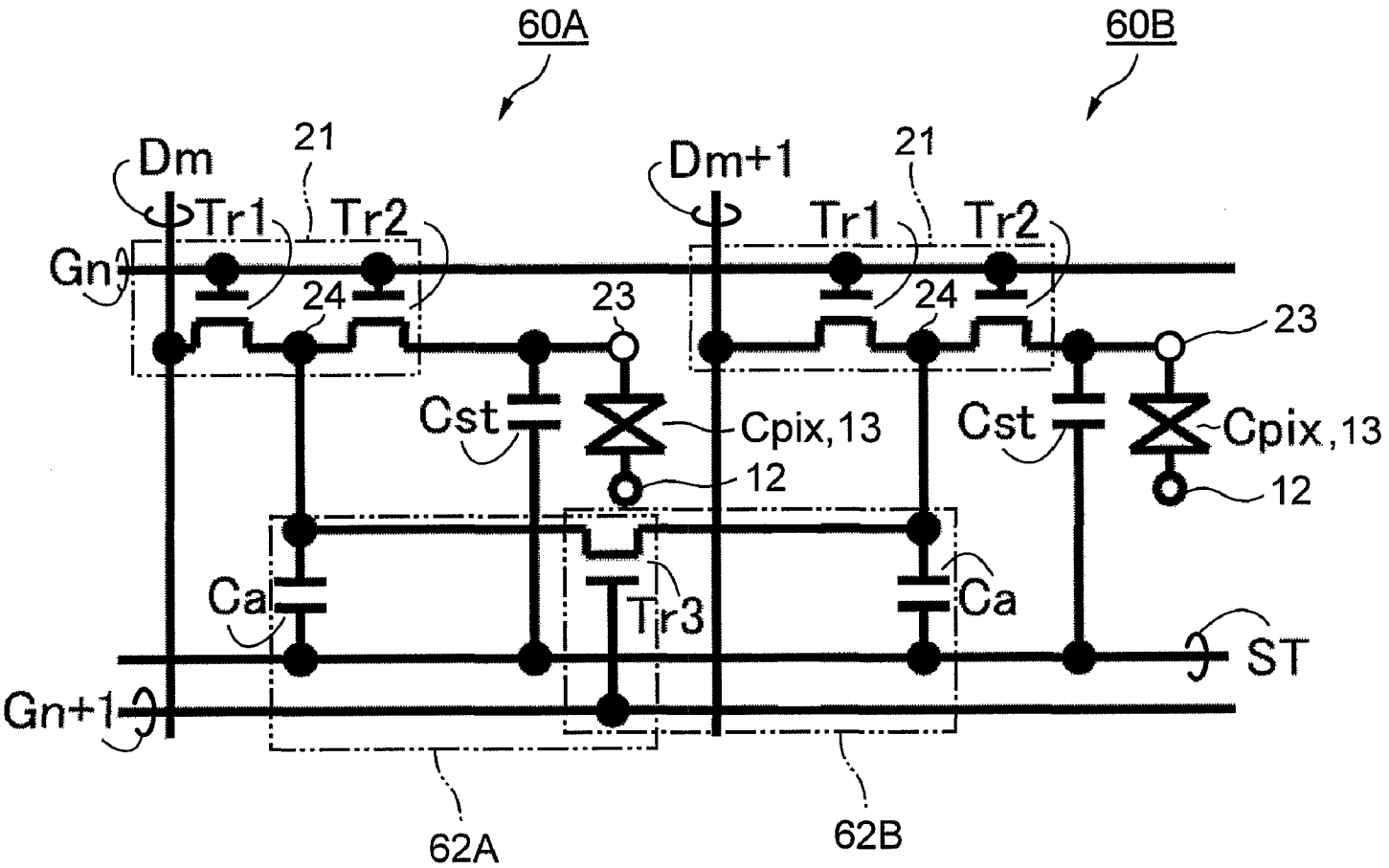
FIG. 5 is a circuit block diagram showing a fourth exemplary embodiment of the pixel matrix and the liquid crystal display device according to the invention, which shows an equivalent circuit for two pixels.
Figure 6:
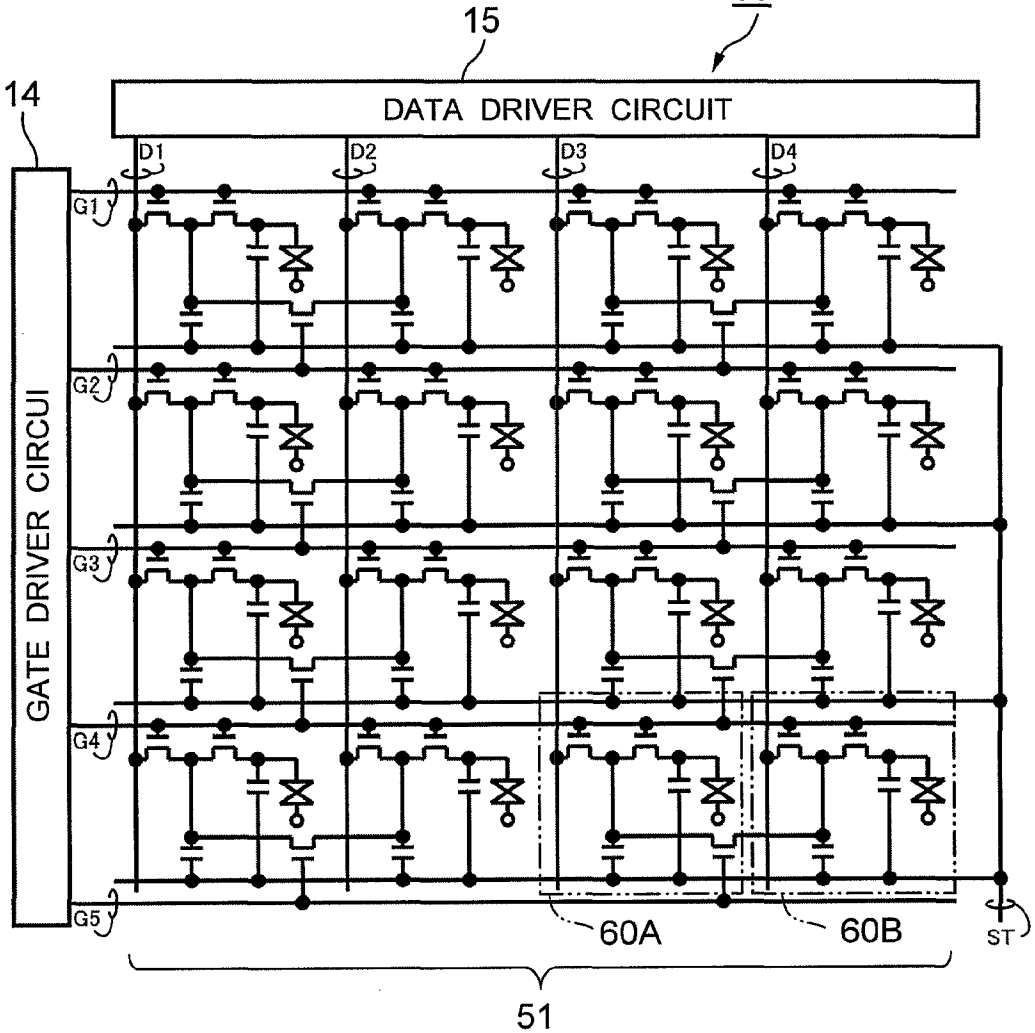
FIG. 6 is a circuit block diagram showing the fourth exemplary embodiment of the pixel matrix and the liquid crystal display device according to the invention, which shows the entire equivalent circuits.

FIG. 5 and FIG. 6 are circuit block diagrams showing a fourth exemplary embodiment of the pixel matrix and the liquid crystal display device according to the present invention. FIG. 5 is an equivalent circuit for two pixels, and FIG. 6 shows entire equivalent circuits. Explanations will be provided hereinafter by referring to those drawings. Same reference numerals are applied to the same components as those of FIG. 1 and FIG. 2, and explanations thereof will be omitted.

In a pixel matrix 51 of this exemplary embodiment, switch devices 62A, 62B within pixels 60A, 60B are different from those of the pixel matrix 11 of the first exemplary embodiment. That is, the pixel matrix 51 is configured with the pixels 60A and 60B, each having a pixel electrode 23, which are arranged in matrix in the vicinity of intersection points between the gate lines G1-G4 and the data lines D1-D4. Each of the pixels 60A and 60B includes a switch device 21 as a first switch device. The switch device 21 has transistors Tr1, Tr2 as a plurality of transistors A connected in series. When selected by a gate line Gn that is one of the gate lines G1-G4, Tr1 and Tr2 are set ON simultaneously to apply, to the pixel electrode 23, a voltage that is supplied from a data line Dm or a data line Dm+1, which is one of the data lines D1-D4. Further, the pixel matrix 51 includes a transistor Tr3 as a transistor B provided to the pixel 60A, and control capacitors Ca as a plurality of capacitors provided to each of the pixels 60A and 60B. The source electrode and the drain electrode of the transistor Tr3 are connected to a connection point 24 between the transistors Tr1, Tr2 of the pixel 60A and to a connection point 24 between the transistors Tr1, Tr2 of the pixel 60B, and the gate electrode thereof is connected to the gate line Gn+1 that is different from the gate line Gn. One end of the control capacitor Ca is connected to the connection point 24, and the other end is connected to the wiring ST of a prescribed potential.

Further, each of the pixels 60A and 60B has a counter electrode 12 that is disposed on the same substrate where the pixel electrode 23 is provided, or on a separate substrate. Each of the pixels 60A and 60B is controlled by an electric field between the pixel electrode 23 and the counter electrode 12. In the two pixels 60A and 60B whose connection points 24 between the respective transistors Tr1 and Tr2 are connected via the transistor Tr3, the counter electrodes 12 have the same potential, and signals applied to the pixel electrodes 23 of each of the pixels 60A, 60B have different polarities for the respective counter electrodes 12.

Further, each of the pixels 60A and 60B has a wiring ST as a common electrode. The gate electrodes of the transistors Tr1, Tr2 are connected to the gate line Gn in common, the source electrode of the transistor Tr1 is connected to the drain electrode of the transistor Tr2, the drain electrode of the transistor Tr1 of the pixel 60A is connected to the data line Dm, the drain electrode of the transistor Tr1 of the pixel 60B is connected to the data line Dm+1, and the source electrode of the transistor Tr2 is connected to the pixel electrode 23. A control capacitor Ca is connected between the wiring ST and the connection point 24 of the transistors Tr1 and Tr2, the gate electrode of the transistor Tr3 is connected to the gate line Gn+1, the drain electrode of the transistor Tr3 is connected to the connection point 24 of the pixel 60A, and the source electrode of the transistor Tr3 is connected to the connection point 24 of the pixel 60B.

Hereinafter, the pixel matrix 51 and the liquid crystal display device 50 according to this exemplary embodiment will be described in more details.

FIG. 6 shows the structure of the liquid crystal display device 50 of this exemplary embodiment, and FIG. 5 shows the arbitrarily-selected two neighboring pixels 60A and 60B. The liquid crystal display device 50 is configured with: the pixel matrix 51 on which pixels are arranged in matrix in the vicinity of each intersection point between the data lines (D1-D4) and the gate lines (G1-G4) provided in lengthwise and widthwise directions; the data driver circuit 15 for driving the data lines; and the gate driver circuit 14 for driving the gate lines. Each pixel includes at least: the two transistors Tr1, Tr2 arranged in series (having one end connected to the data line and the other end connected to the pixel capacitor Cpix and the holding capacitor Cst); the pixel capacitor Cpix connected to Tr2; the holding capacitor Cst; and the control capacitor Ca connected to the connection point between the Tr1 and Tr2. At least one of the two pixels that are connected to two neighboring data lines and connected to a same gate line has a third transistor Tr3. The gate terminal of Tr3 is connected to a gate line that is different from a gate line to which the pixel transistors Tr1, Tr2 of that pixel are connected, and the source and drain terminals thereof are connected to the connection points of the pixel transistors Tr1 and Tr2 of the two neighboring pixels, respectively. The other end of the holding capacitor Cst and the other end of the control capacitor Ca are connected to the wiring ST that is used in common to the whole pixels. Each pixel capacitor Cpix is a capacitor that is configured with the pixel electrode 23 on the TFT substrate having the transistors formed on the surface and, although not shown, the counter electrode 12 of the counter substrate which opposes to the TFT substrate with the liquid crystal layer 13 interposed therebetween. Further, the number of output terminals of the gate driver circuit 14 is larger at least by one than the number of pixel rows of effective pixels that contribute to the display of the pixel matrix 51, and the terminals thereof are connected to a gate line G5 arranged along the edge part of the effective pixels of the pixel matrix 51.

Next, the gate line Gn and the data line Dm will be described by specifying those in a concretive manner. Specifically, in the two pixels 60A and 60B neighboring to each other on the left and right sides, which are connected to the gate line G1 and to the two neighboring data lines D1 and D2, the gate terminals of Tr1 and Tr2 of the pixel 60A that is connected to D1 are connected to G1. Tr3 is provided to the pixel 60A, and the gate terminal of Tr3 is connected to G2. There is no Tr3 provided to the pixel 60B that is connected to D2, and the gate terminals of Tr1, Tr2 are connected to G1. The source terminal of Tr3 of the pixel 60A that is connected to D1 is connected to the connection point 24 between Tr1, Tr2 of the pixel 60A that is connected to D1, and the drain terminal thereof is connected to the connection point 24 between Tr1, Tr2 of the pixel 60B that is connected to D2. Similarly, in the two pixels 60A and 60B neighboring to each other on the left and right sides, which are connected to the neighboring data lines D3 and D4, Tr3 is provided to the pixel 60A that is connected to D3. The source terminal of the transistor Tr3 is connected to the connection point between Tr1 and Tr2 of the pixel 60A that is connected to D3, and the drain terminal thereof is connected to the connection point 24 between Tr1 and Tr2 of the pixel 60B that is connected to D4.

However, in the pixels neighboring to each other on the left and right sides, which are connected to the neighboring data lines D2 and D3, the intermediate points between Tr1 and Tr2 are not connected via a transistor. That is, the connection points between the transistors Tr1 and Tr2 of each pixel are connected via the third transistor Tr3 that is provided to one of the pixels to be in pair, out of the two pixels neighboring to each other on the left and right sides.

In the case shown in FIG. 6, there are four data lines and four gate lines that are connected to the effective pixels. However, the number of those lines is not limited to such numerical value. Further, the data driver circuit 15 and the gate driver circuit 14 may be formed by a same process on the substrate where the pixel transistors are formed, or one of the circuits or the both circuits may be formed on another substrate and electrically connected to the transistors.

Figure 7:
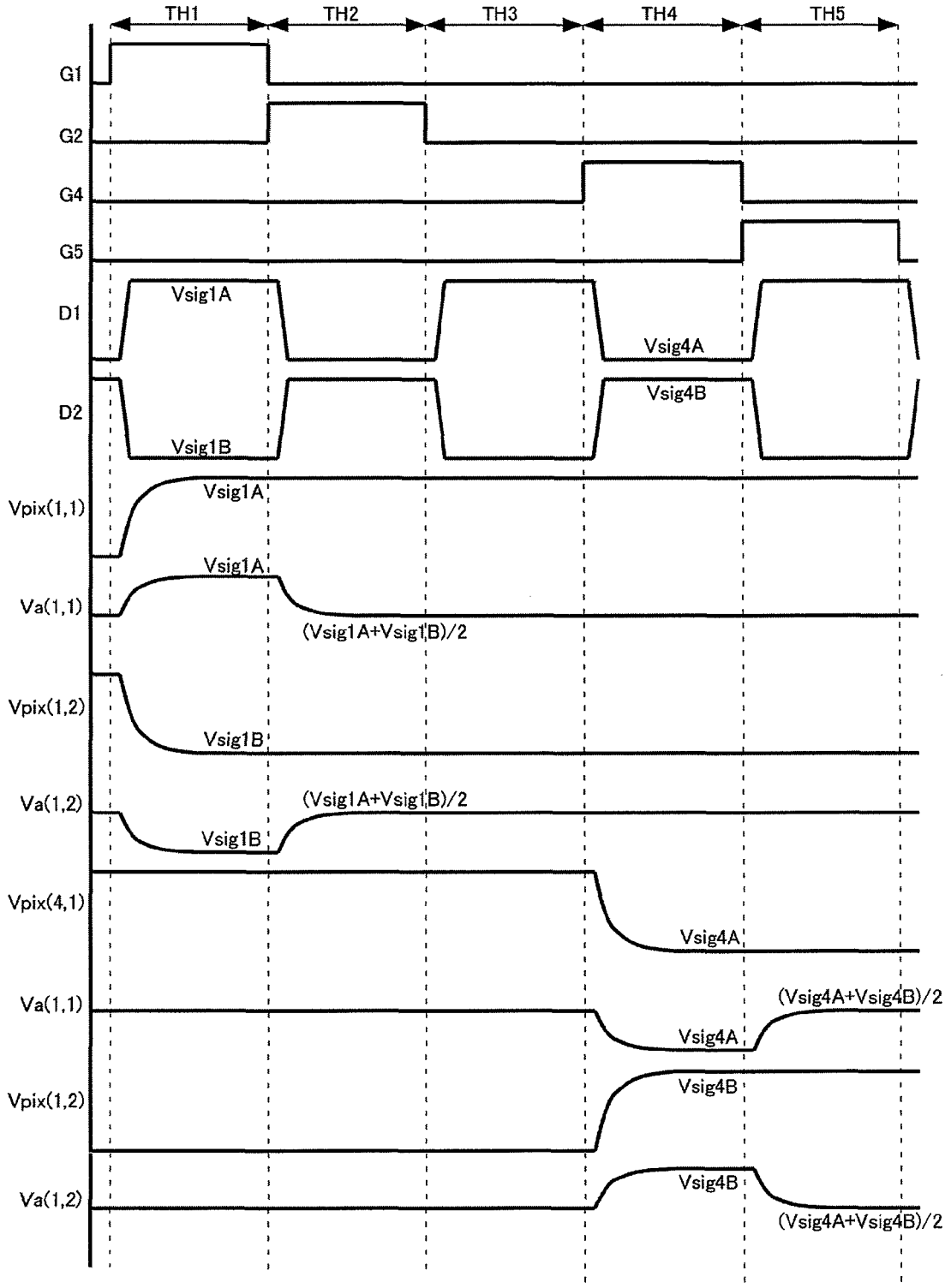
FIG. 7 is a timing chart showing operations of the pixel matrix and the liquid crystal display device shown in FIG. 5 and FIG. 6.

Next, the operations will be described by referring to a timing chart shown in FIG. 7. This timing chart shows changes in the control signal line, the pixel voltage, and the like in a period where the video signals are written to a plurality of pixel rows of the liquid crystal display device according to the exemplary embodiment. Each of periods TH1-TH4 indicates one horizontal period for writing a video signal for one pixel row. G1-G5 are voltage waveforms of the gate lines G1-G5, respectively, and D1, D2 are voltage waveforms of the data lines D1, D2, respectively. "Vpix (1, 1)" shows a pixel electrode potential (pixel capacitor potential) of the pixel connected to the gate line G1 and the data line D1, and Va (1, 1) shows a voltage of the control capacitor Ca of that pixel. Similarly, "Vpix (1, 2)" shows a pixel electrode potential of the pixel connected to the gate line G1 and the data line D2, and Va (1, 2) shows a voltage of the control capacitor Ca of that pixel.

In the period TH1, for the pixel connected to the gate line G1 and the data line D1, the pixel transistors Tr1 and Tr2 are set to an ON-state when the potential of the gate line G1 changes to a voltage that makes Tr1, Tr2 electrically conductive. With this, a potential Vsig1A of the data line D1 is written to the pixel capacitor Cpix and the holding capacitor Cst. Note here that Vsig1A is a voltage corresponding to the video signal to be displayed on the pixel. Simultaneously with this, the same voltage Vsig1A is also written to the control capacitor Ca. At this time, the gate terminal of Tr3 is connected to the gate line G2, so that it is in an OFF-state. At the same time, for the pixel connected to the gate line G1 and the data line D2, a potential Vsig1B of the data line D2 is written to the pixel capacitor Cpix, the holding capacitor Cst, and the control capacitor Ca. Then, when the potential of G1 changes to a potential that makes the pixel transistors Tr1, Tr2 nonconductive, all of the transistors Tr1, Tr2, Tr3 of each pixel connected to G1 come to be in an OFF-state. The similar operations are executed at each of the pixels connected to the data lines D3, D4 and the gate line G1, and the video signal for one pixel row is written to the pixel capacitor Cpix and the holding capacitor Cst.

Then, in the period TH2, the gate line G2 changes to a potential that makes the pixel transistor electrically conductive, so that each of the transistors Tr3 of the pixels connected to the gate line G1 is changed to be in an ON-state. Thus, the potentials of the control capacitors Ca change to a mean voltage of the potentials of the two neighboring pixels. Specifically, regarding the pixel connected to the gate line G1 and the data line D1 and the pixel connected to the gate line G1 and the data line D2, the potentials of the control capacitors Ca of both pixels change to the voltage of (Vsig1A+Vsig1B)/2, as shown in FIG. 7. Simultaneously with this, the video signal is written to the pixel capacitors Cpix and the holding capacitors Cst of each pixel that is connected to the gate line G2 by the same operations as those described above.

The period TH4 is a period where the video signal is written to each pixel that is connected to the gate line G4 to which the video signal is written lastly among the effective pixels. The operations for writing the video signal to the pixel capacitors Cpix and the holding capacitors Cst of each pixel that is connected to the gate line G4 is the same operations as those described above. At the end of the period TH4, the video signal for displaying the video at each pixel is being written to the pixel capacitor Cpix, the holding capacitor Cst, and the control capacitor Ca of each pixel that is connected to the gate line G4.

Next, in the period TH5, the gate line G5 changes to a potential that makes the pixel transistor electrically conductive, so that each of the transistors Tr3 of the pixels connected to the gate line G4 is changed to be in an ON-state. With this, the potentials of the control capacitors Ca of each pixel connected to the gate line G4 change to a mean voltage of the potentials of the two neighboring pixels. By a series of these operations, the video signal is written to each of the whole pixel capacitors Cpix and holding capacitors Cst of the effective pixels. Thus, the control capacitors Ca come to have the mean voltage of the two neighboring pixels in the period where each pixel is in a video signal holding operation (operation under a state where the pixel transistors Tr1 and Tr2 of each pixel are in an OFF-state). Provided that the liquid crystal display device employs an AC drive method in which the polarities of the potentials of the neighboring data lines for the counter electrode are different in an arbitrary horizontal period (dot inversion or data line inversion), the potentials of the control capacitors Ca of each pixel come to have a value close to the potential of the counter electrode on an average.

While the pixel transistors Tr1, Tr2, and Tr3 are n-type transistors in the case that has been described heretofore, it is also possible to use p-type transistors. In that case, the potential of each gate line may simply be changed to the state for allowing the p-type to be conductive and nonconductive.

Further, regarding channel widths W1-W3 of Tr1, Tr2, and Tr3 (FIG. 17), the channel width W3 of Tr3 may be set smaller than the channel widths W1, W2 of Tr1, Tr2. The reason is that it is sufficient for Tr3 to have a characteristic for writing the control capacitor Ca, and the value of Ca may be a value that is smaller than the total of the pixel capacitor Cpix and the holding capacitor Cst.

With the liquid crystal display device according to the present invention, fluctuation of the voltage in the holding period of the pixel capacitor Cpix and the holding capacitor Cst can be suppressed to be small. Thus, it is possible to reduce flicker and crosstalk greatly. Further, the structure of the present invention can be achieved by a method with a low process cost. Furthermore, the numerical aperture is not deteriorated largely with the structure of the present invention. The reasons for that will be described hereinafter.

When dot inversion or gate line inversion is used among the method for AC driving the liquid crystal, in almost half the period from the point where a video signal is written to the pixel capacitor Cpix and the holding capacitor Cst of each pixel to the point where a next video signal is written thereto, a video signal having different polarity from the polarity of the video signal written to the corresponding pixel for the counter electrode is written to the data line which is connected to that pixel. However, in the liquid crystal display device according to the present invention, the control capacitor Ca is provided to the connection point between the pixel transistors Tr1, Tr2, and a voltage that is close to the potential of the counter electrode is written in the control capacitor Ca in most of the period where Tr1 and Tr2 are in the holding operation. Therefore, the source-drain voltage Vds of the transistor Tr2 connected to the pixel capacitor Cpix and the holding capacitor Cst comes to be irrelevant to the potential of the data line. Further, the potentials of the control capacitors Ca become close to the potential of the counter electrode on an average, so that the extent of Vds can also be reduced on an average. Therefore, flicker and crosstalk can be reduced.

When data line inversion drive is used, among each of the pixels of the liquid crystal display device, the influences are different in a pixel to which a video signal is written at an early stage of one frame and in a pixel to which the video signal is written at the last stage. In the case of the pixel to which the video signal is written at the early stage, the polarity of the signal written to the pixel for the counter electrode is the same as the polarity of the signal applied to the data line for the counter electrode in most of the frame period. Meanwhile, in the case of the pixel to which the video signal is written at the last stage, the polarity of the video signal written to the pixel for the counter electrode is different from the polarity of the signal applied to the data line for the counter electrode in most of the frame period. Therefore, in a traditional liquid crystal display device, the source-drain voltage of the pixel transistor is small in the pixel to which the video signal is written at the early stage, and the leak current becomes small as well. In the meantime, the source-drain voltage of the pixel transistor is large in the pixel to which the video signal is written at the last stage, and the leak current becomes large as well. Therefore, flicker and crosstalk become extensive in the pixel to which the video signal is written at the last stage, so that it is difficult to make the flicker uniform within a plane of the liquid crystal display device.

In the meantime, with the liquid crystal display device of the present invention, the source-drain voltage Vds of the transistor Tr2 that is connected to the pixel capacitor and the holding capacitor of each pixel becomes irrelevant to the data line potential. Thus, the potentials of the control capacitors Ca become close to the potential of the counter electrode on an average, so that it is also possible to reduce the extent of Vds on an average. Therefore, there is no difference between the leak current of the pixel to which the video signal is written at the early stage and the leak current of the pixel to which the video signal is written at the last stage. As a result, it is possible to reduce the flicker and crosstalk greatly.

Further, since it is possible to configure all the transistors used for the pixels with the transistors of a same type. Thus, compared to a case where both p-type and n-type transistors are used, the process cost can be reduced. Further, it is unnecessary to provide any exclusive control lines other than the gate lines and data lines for controlling the three transistors Tr1-Tr3 in each pixel. Therefore, deterioration of the numerical aperture can be suppressed to a minimum.

Fifth Exemplary Embodiment

Figure 8:
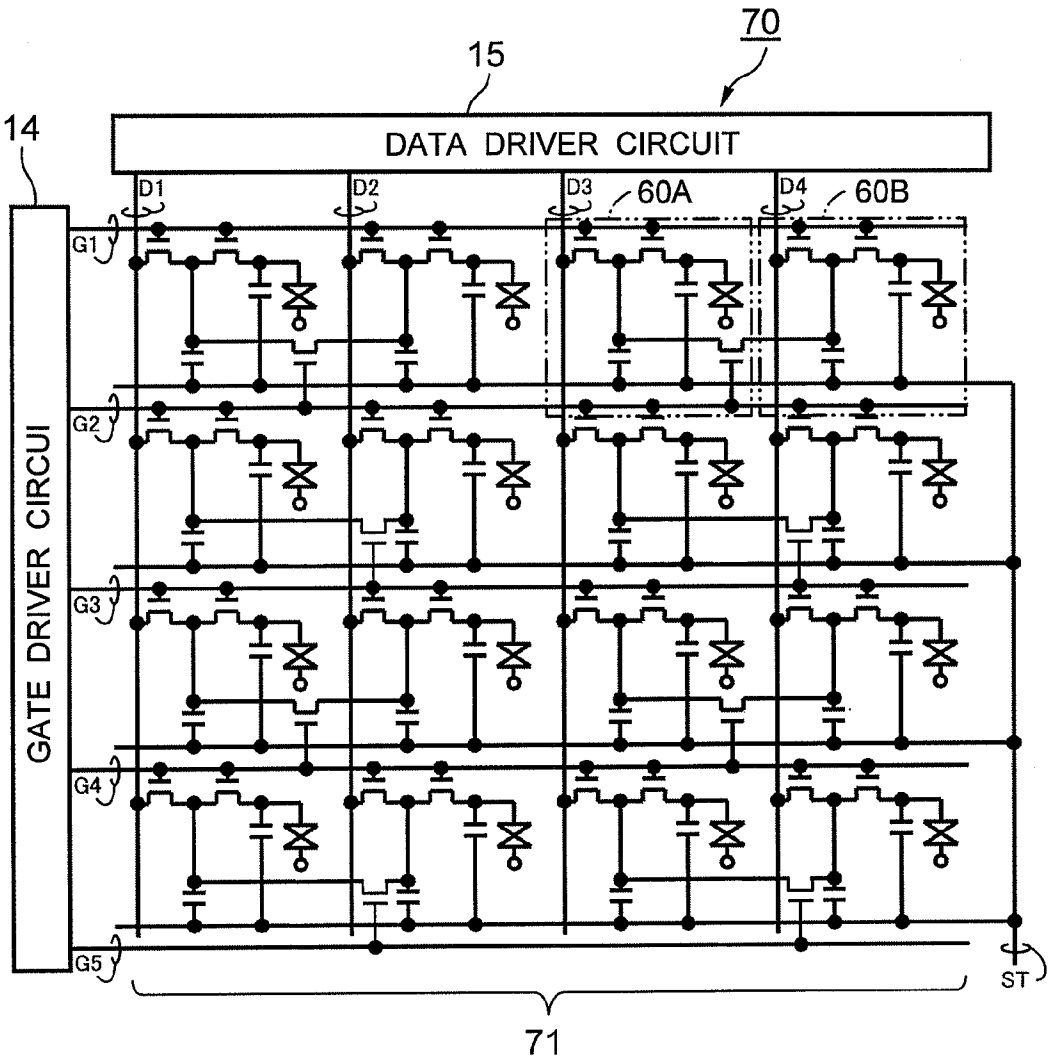
FIG. 8 is a circuit block diagram showing a fifth exemplary embodiment of the pixel matrix and the liquid crystal display device according to the invention, which shows the entire equivalent circuits.

FIG. 8 is a circuit block diagram showing a fifth exemplary embodiment of the pixel matrix and the liquid crystal display device according to the present invention, and it shows entire equivalent circuits. Explanations will be provided hereinafter by referring to this drawing. Same reference numerals are applied to the same components as those of FIG. 5 and FIG. 6, and explanations thereof will be omitted.

A pixel matrix 71 and a liquid crystal display device 70 of this exemplary embodiment are different from the pixel matrix 51 and the liquid crystal display device 50 of FIG. 5 and FIG. 6 in terms of the layout of the pixels 60A and 60B. That is, the way of making a pair to which a control capacitor Ca is connected via a transistor Tr3 in the two neighboring pixels 60A and 60B is different. In the exemplary embodiment shown in FIG. 6, out of the pixels, the pixel to which Tr3 is provided is disposed to one of the two neighboring data lines in a biased manner. However, in the fifth exemplary embodiment, the pixel with Tr3 is disposed alternately. Other than that, the fifth exemplary embodiment is the same as the exemplary embodiment shown in FIG. 6, and the operating method thereof is the same as well. Further, the pixel transistors Tr1, Tr2, and Tr3 may also be configured with p-type transistors.

With the liquid crystal display device according to the fifth exemplary embodiment, the same effects as those of the liquid crystal display device shown in FIG. 6 can be obtained. Further, the pixel where Tr3 is provided is in a telescopic form, which means that the pixel whose numerical aperture becomes deteriorated by providing Tr3 is also in a telescopic form. Thus, it is possible to achieve such an effect that differences in the luminance due to differences in the numerical aperture can be leveled.

Sixth Exemplary Embodiment

Figure 9A:
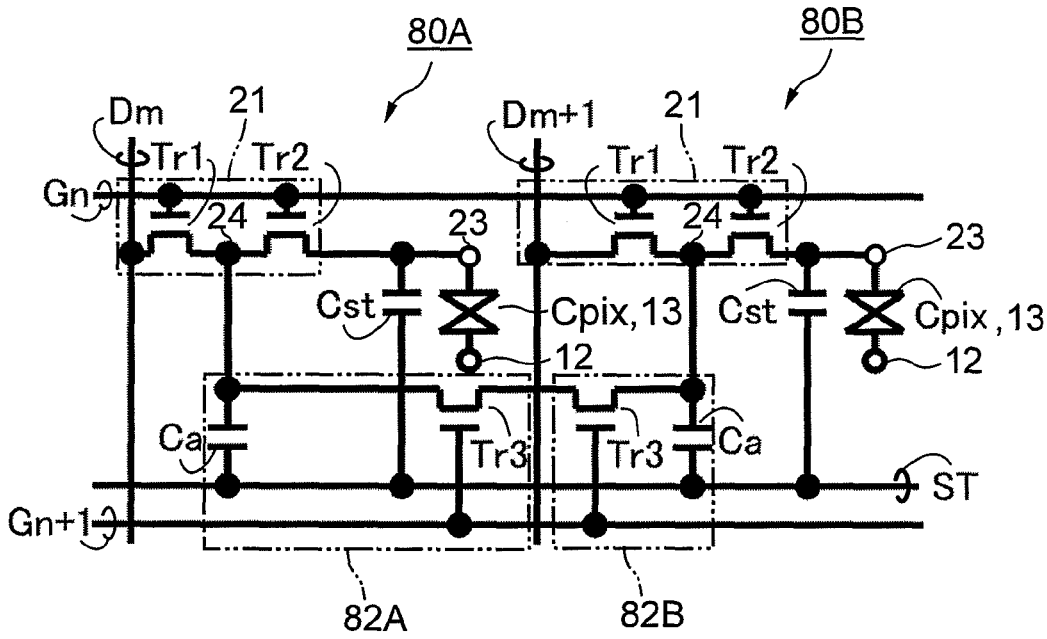
FIG. 9A is a circuit block diagram showing a sixth exemplary embodiment of the pixel matrix and the liquid crystal display device according to the invention, which shows an equivalent circuit for two pixels.

FIG. 9A is a circuit block diagram showing a sixth exemplary embodiment of the pixel matrix and the liquid crystal display device according to the present invention, and it is an equivalent circuit for two pixels. Explanations will be provided hereinafter by referring to this drawing. Same reference numerals are applied to the same components as those of FIG. 5, and explanations thereof will be omitted.

In pixels 80A, 80B according to this exemplary embodiment, switch devices 82A, 82B are different from those of the pixels 60A, 60B shown in FIG. 5. That is, the sixth embodiment is different in respect that Tr3 is provided to all of the pixels 80A and 80B. In the case shown in FIG. 5, the control capacitors Ca of the two neighboring pixels 60A, 60B are connected via a single Tr3, whereas the control capacitors Ca are connected via two transistors Tr3 provided, respectively, to the pixels 80A and 80B in the sixth exemplary embodiment. Other than that, the sixth exemplary embodiment is the same as the exemplary embodiment shown in FIG. 6, and the operating method thereof is the same as well. Further, the pixel transistors Tr1, Tr2, and Tr3 may also be configured with p-type transistors.

With the liquid crystal display device according to this exemplary embodiment, the same effects as those of the liquid crystal display device shown in FIG. 6 can be achieved. Further, the transistor Tr3 is provided to all the pixels, so that the mean value of the numerical apertures of the entire pixels becomes small. However, the numerical apertures of each pixel can be made uniform.

Seventh Exemplary Embodiment

Figure 9B:
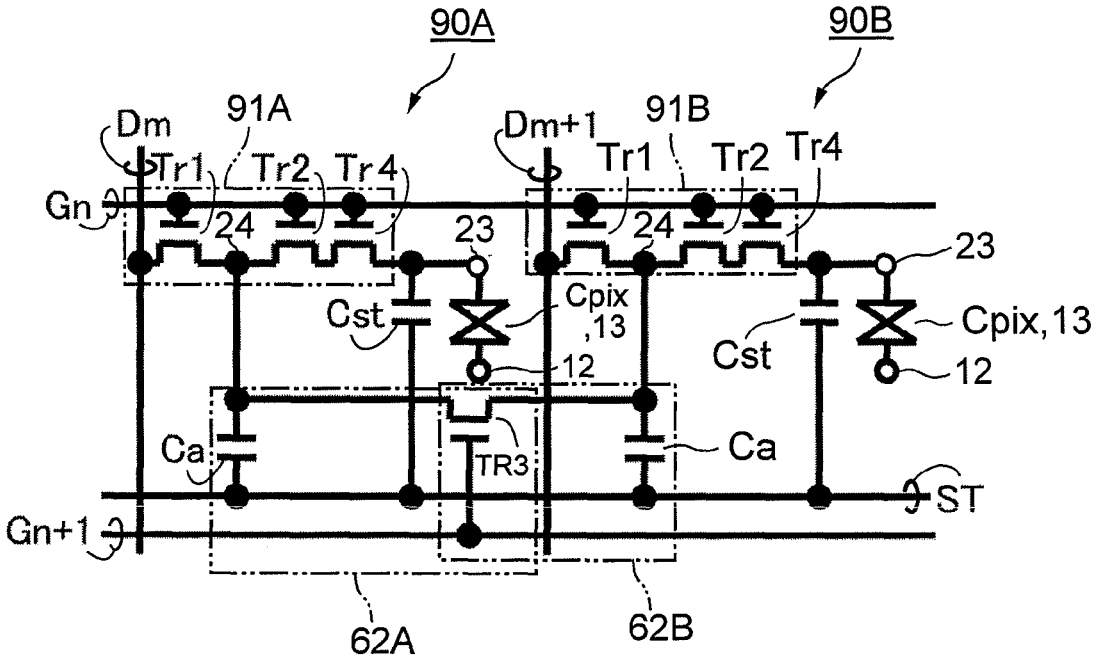
FIG. 9B is a circuit block diagram showing a seventh exemplary embodiment of the pixel matrix and the liquid crystal display device according to the invention, which shows an equivalent circuit for two pixels.

FIG. 9B is a circuit block diagram showing a seventh exemplary embodiment of the pixel matrix and the liquid crystal display device according to the present invention, and it is an equivalent circuit for two pixels. Explanations will be provided hereinafter by referring to this drawing. Same reference numerals are applied to the same components as those of FIG. 5, and explanations thereof will be omitted.

In pixels 90A, 90B according to this exemplary embodiment, switch devices 91A, 91B are different from those of the pixels 60A, 60B shown in FIG. 5. That is, the difference with respect to the structure shown in FIG. 5 is that, among the transistors of the two pixels 90A, 90B neighboring to each other on the left and right sides for connecting the data line and the liquid crystal capacitors, the transistor that is connected to the liquid crystal capacitor side has double gates (Tr2, Tr4). The case of configuring the pixel transistors with n-type transistors has been described herein. However, the transistors may also be configured with p-type transistors.

Operations of the liquid crystal display device according to the seventh exemplary embodiment are the same as the operations of the liquid crystal display device shown in FIG. 6. With the liquid crystal display device according to the seventh exemplary embodiment, it is possible to obtain the same effects as those of the liquid crystal display device shown in FIG. 6. Further, since the transistor connected to the pixel capacitor is formed as a double-gate transistor with Tr2 and Tr4, the source-drain voltage of each transistor is divided to be small. Thus, the leak current can be reduced further.

Eighth Exemplary Embodiment

FIG. 10-FIG. 15 are plan views showing an example of a method for manufacturing the pixel matrix and the liquid crystal display device according to the first exemplary embodiment. Explanations will be provided hereinafter by referring to those drawings.

Figure 10:
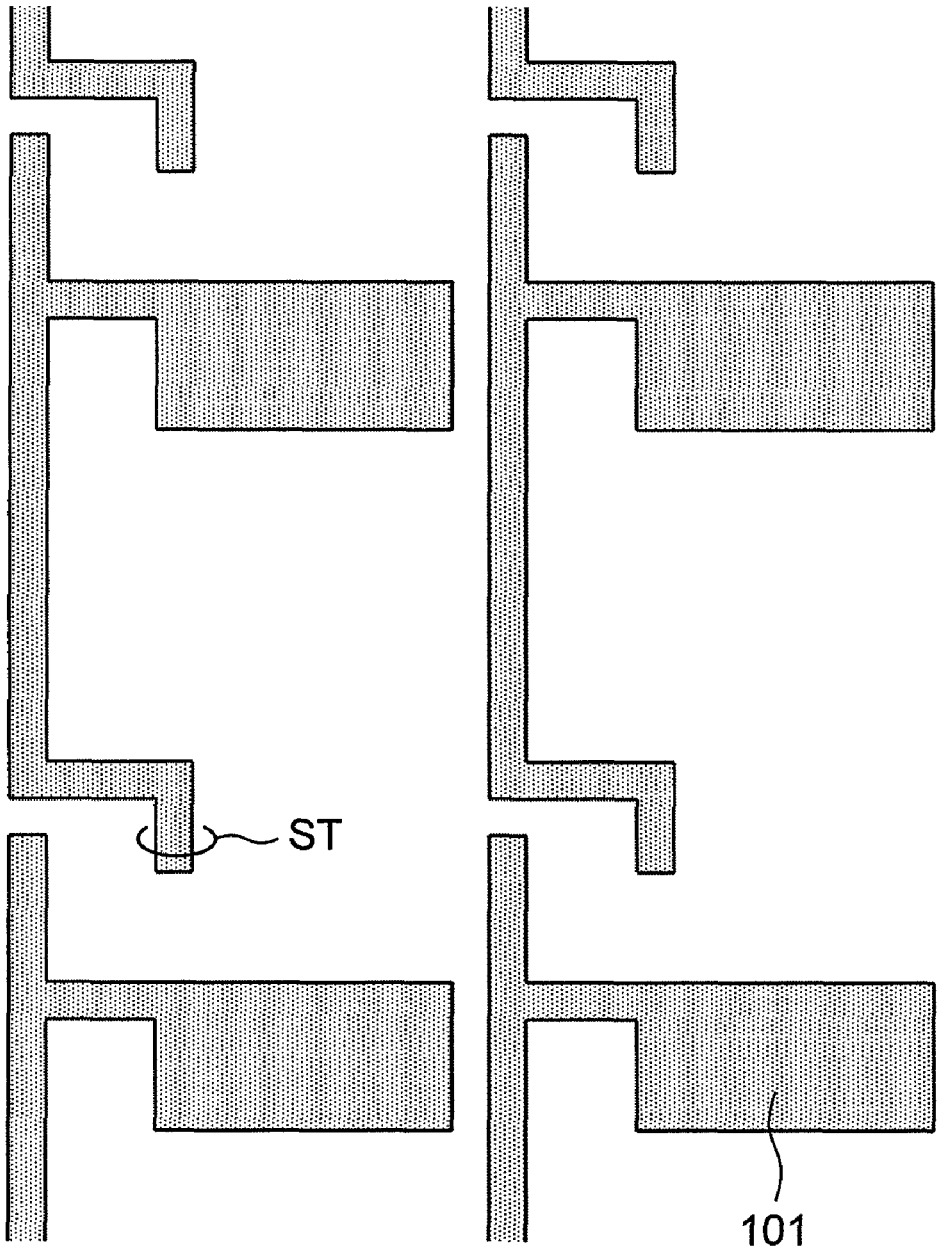
FIG. 10 is a plan view showing an example (a) of a method for manufacturing the pixel matrix and the liquid crystal display device according to the first exemplary embodiment.

In FIG. 10-FIG. 15, pixel layouts are illustrated by a unit of main process steps. First, an insulating film of $SiO_2$ or SiN is formed on a transparent substrate such as glass, quarts, or plastics, a semiconductor layer 101 to be TFT is formed thereon, and patterning is performed. FIG. 10 shows the pixel layout of a stage where the process up to patterning of the semiconductor layer 101 is completed. Processing such as annealing, impurity doping, hydrogenation, and activation is performed to the semiconductor layer 101 as necessary in a process step that is optimum for the respective processing.

Figure 11:
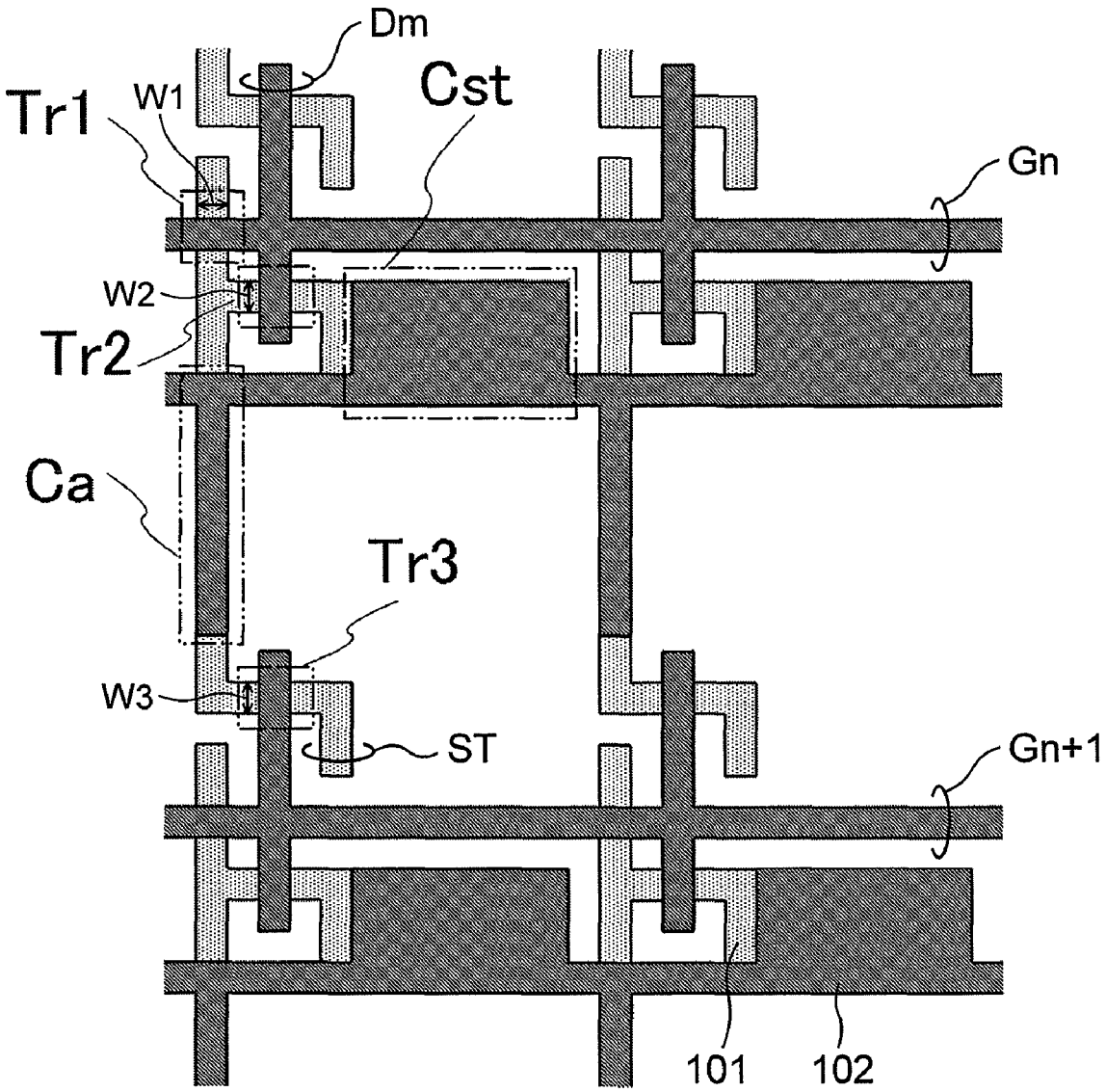
FIG. 11 is a plan view showing an example (b) of the method for manufacturing the pixel matrix and the liquid crystal display device according to the first exemplary embodiment.

On the semiconductor layer 101, a gate metal layer 102 is formed and patterned with a thin insulating film made of $SiO_2$, for example, interposed therebetween. FIG. 11 shows the pixel layout after patterning of the gate metal layer 102 is completed. The parts surrounded by alternate long and two dash lines indicated by Tr1-Tr3 in the drawing are the parts corresponding to the transistors Tr1-Tr3 of each pixel 20 in the pixel matrix 11 and the liquid crystal display device 10 shown in FIG. 1 and FIG. 2. Similarly, the parts surrounded by alternate long and two dash lines indicated by Cst and Ca are the parts to be the holding capacitor Cst and the control capacitor Ca. These capacitors are configured with a thin gate insulating film sandwiched between the gate metal layer 102 and the semiconductor layer 101, and the semiconductor layer 101 of those parts have a high-concentration impurity doped in advance. As the metal used for the gate, Wsi, Mo, Cr, Al, or the like can be used depending on the highest temperature of the process.

Figure 12:
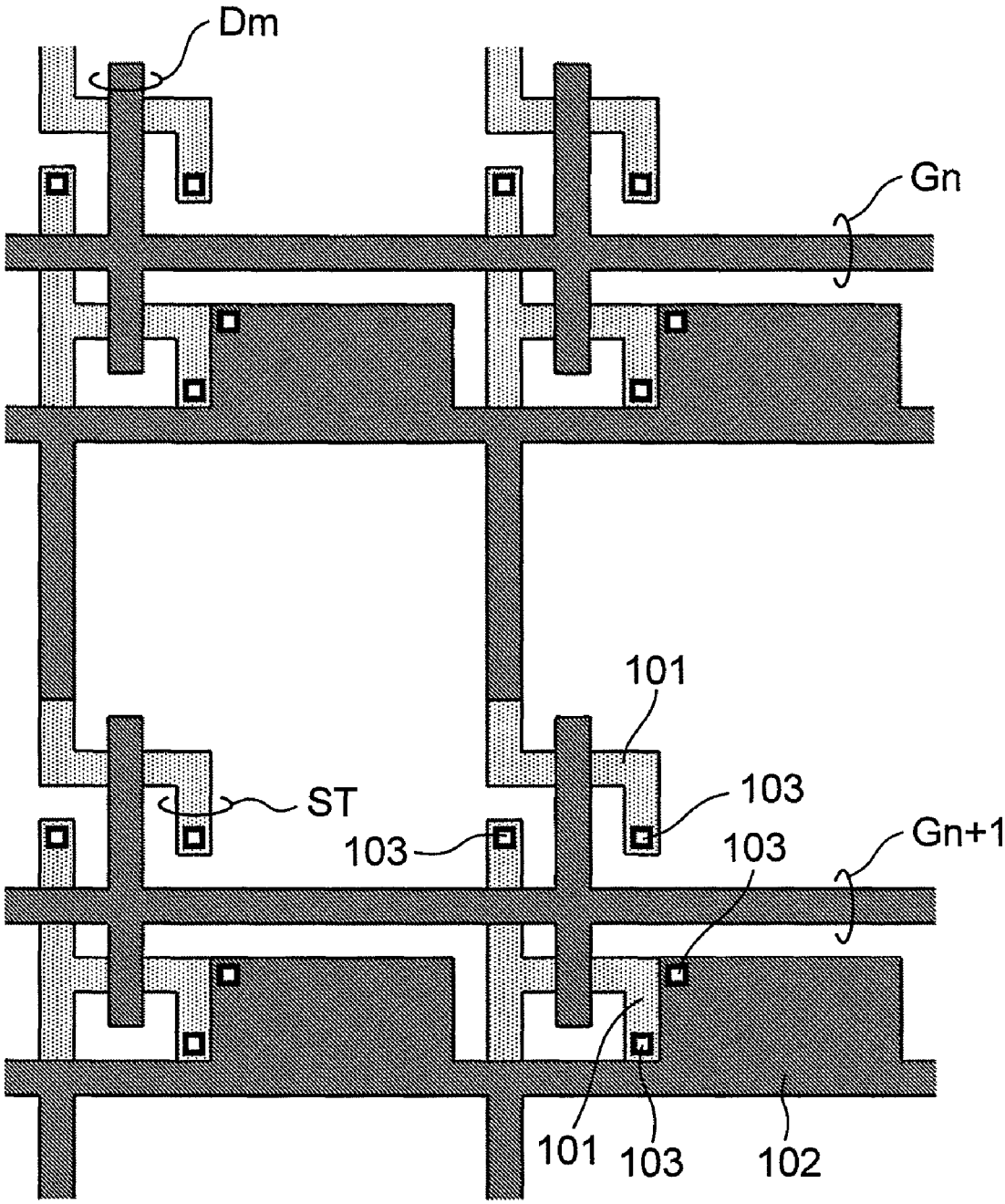
FIG. 12 is a plan view showing an example (c) of the method for manufacturing the pixel matrix and the liquid crystal display device according to the first exemplary embodiment.

Thereafter, an insulating film made of $SiO_2$ or the like is formed, and a contact hole 103 for electrically connecting a data line metal layer (will be described later) and the semiconductor layer 101 or the gate metal layer 102 are formed at necessary points. FIG. 12 shows that state.

Figure 13:
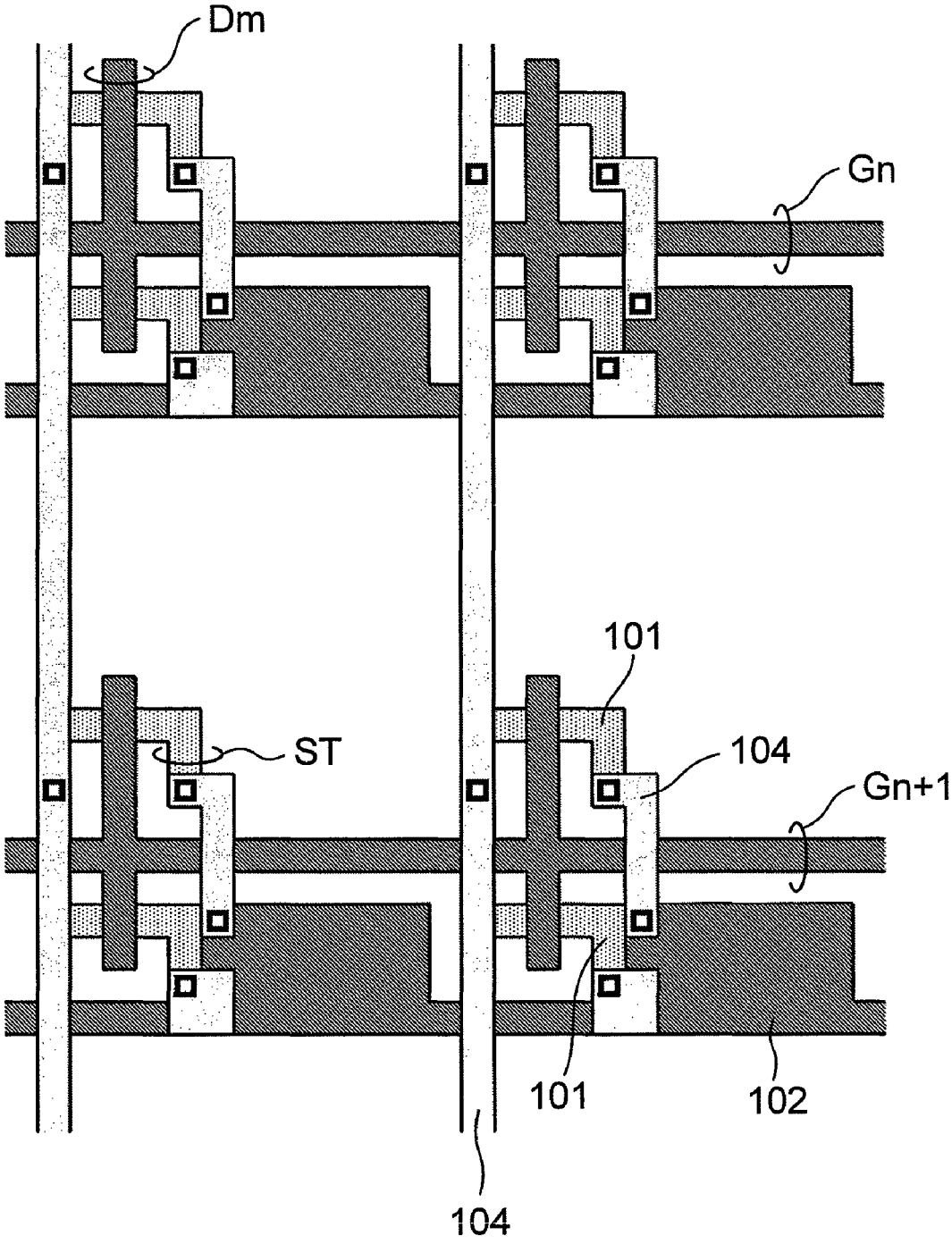
FIG. 13 is a plan view showing an example (d) of the method for manufacturing the pixel matrix and the liquid crystal display device according to the first exemplary embodiment.

Thereafter, the data line metal layer 104 is formed and patterned. FIG. 13 shows the pixel layout after patterning of the data line metal layer 104 is completed. It is desirable to use low-resistance metal such as Al for the data line metal layer 104. An insulating film of $SiO_2$ or SiN is formed on the data line metal layer 104. Further, an organic or inorganic flattening film is formed thereon as necessary.

Figure 14:
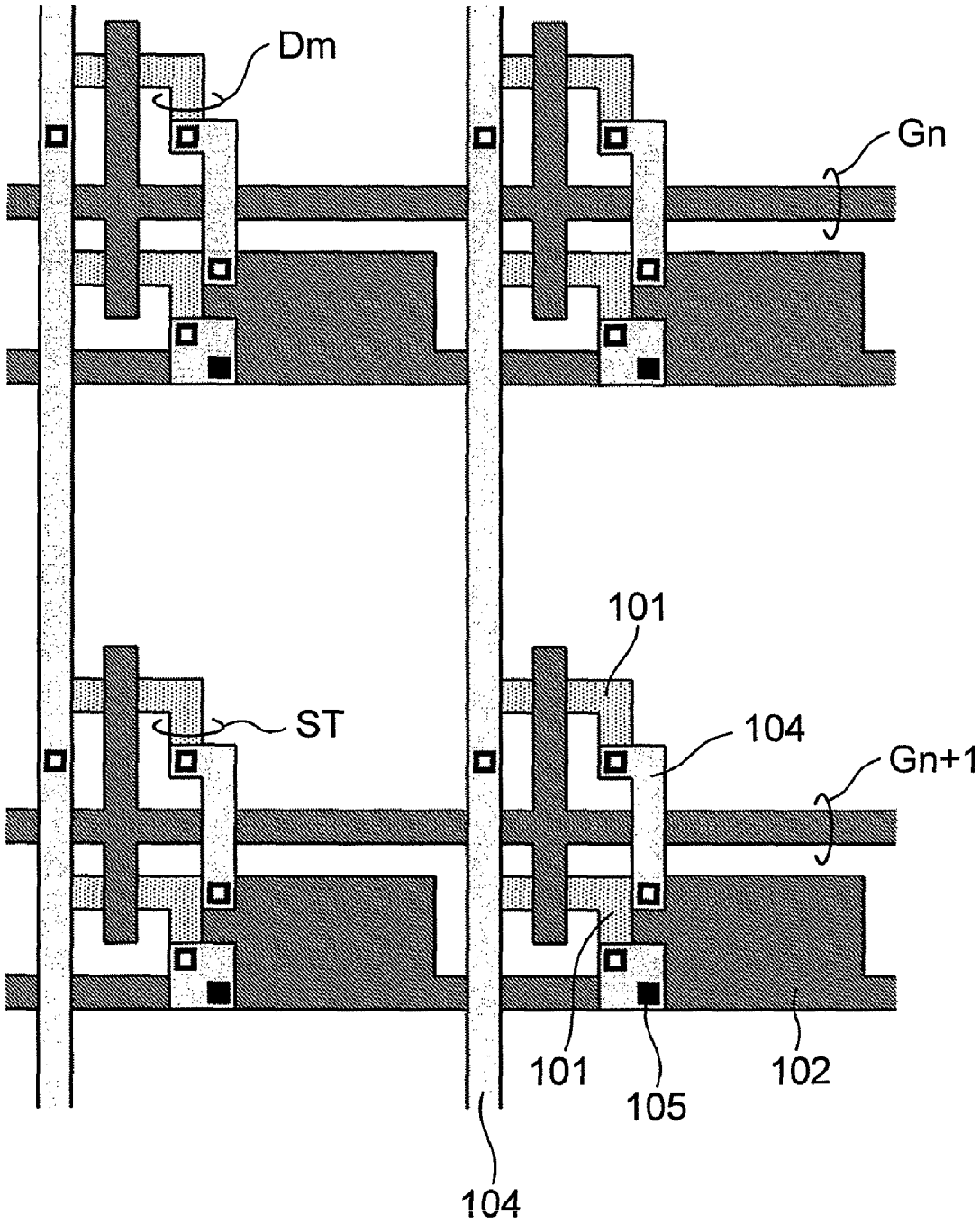
FIG. 14 is a plan view showing an example (e) of the method for manufacturing the pixel matrix and the liquid crystal display device according to the first exemplary embodiment.

FIG. 14 shows the layout after a contact hole 105 for electrically connecting the data line metal layer 104 and a pixel electrode metal layer (will be described later) is formed.

Figure 15:
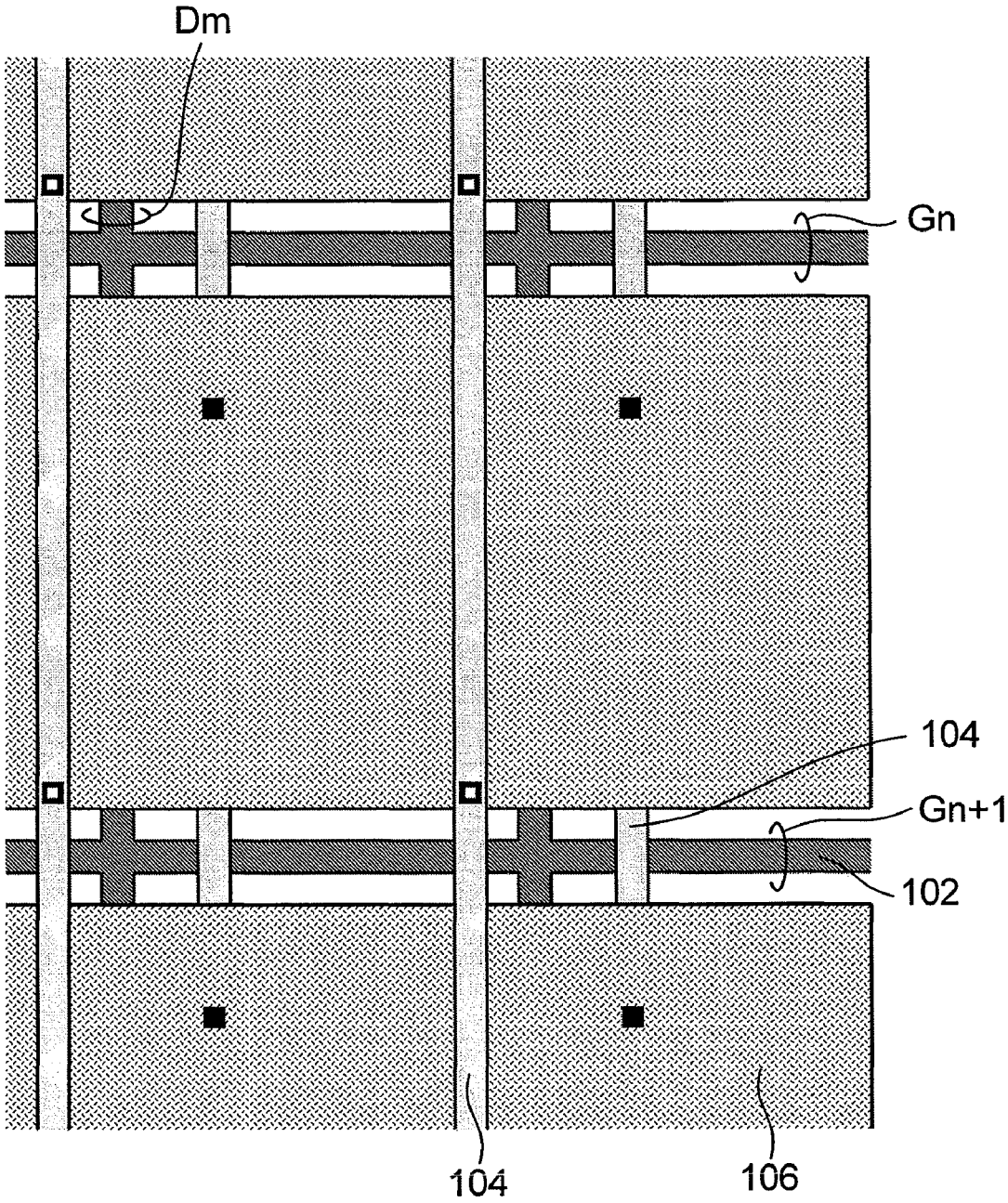
FIG. 15 is a plan view showing an example (f) of the method for manufacturing the pixel matrix and the liquid crystal display device according to the first exemplary embodiment.

FIG. 15 shows the pixel layout after patterning of a pixel electrode metal layer 106 is completed. A transparent electrode film is used for the pixel electrode metal layer 106. An example of the material thereof is ITO.

It is necessary for the pixel electrode metal layer 106 to be electrically connected to the semiconductor layer 101 that forms TFT. In FIG. 15, the case of connecting the pixel electrode metal layer 106 and the semiconductor layer 101 via the data line metal layer 104 is illustrated. However, the pixel electrode metal layer 106 and the semiconductor layer 101 may be connected directly.

The examples presented as the materials for the insulating film and the metal film are irrelevant to the essentials of the present invention, so that other materials may be used as well. Through the steps described above, the TFT substrate described in the first exemplary embodiment can be fabricated. It is possible to fabricate the liquid crystal display device by laminating the TFT substrate and the counter substrate having the counter electrode formed thereon, and by inserting liquid crystals to the gap therebetween. Here, processes that are substantially irrelevant to the present invention, such as a process for aligning the liquid crystals, a process for laminating the substrates, and a process for laminating an optical film such as a polarizing plate, are not described. For those processes, it is possible to select the processes suited for the usage of the liquid crystal display device. Further, the pixel matrixes and the liquid crystal display devices according to the other exemplary embodiments can also be fabricated with the same method.

Ninth Exemplary Embodiments

FIG. 16-FIG. 21 are plan views showing an example of a method for manufacturing the pixel matrix and the liquid crystal display device according to the fourth exemplary embodiment. Explanations will be provided hereinafter by referring to those drawings.

Figure 16:
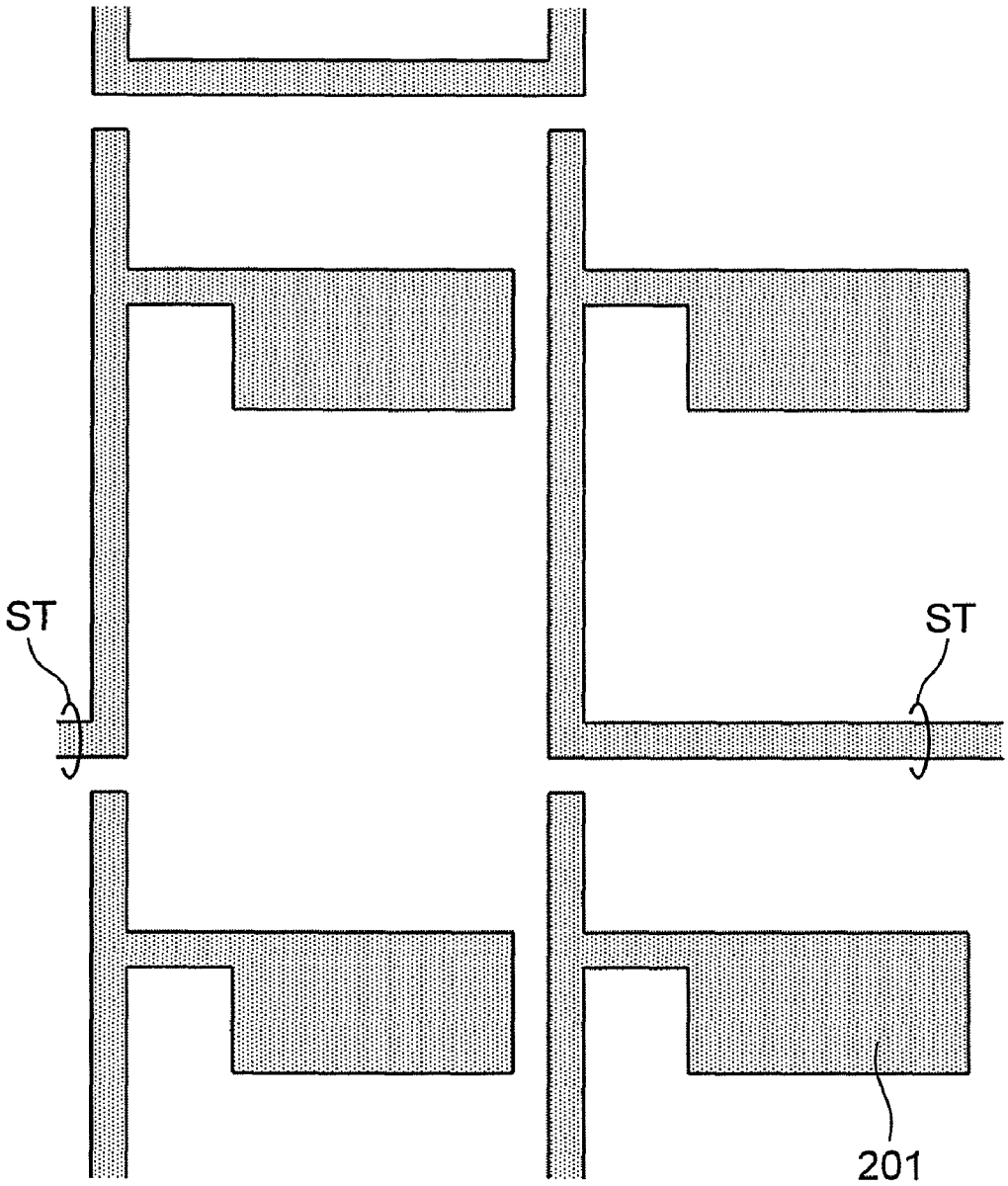
FIG. 16 is a plan view showing an example (a) of a method for manufacturing the pixel matrix and the liquid crystal display device according to the fourth exemplary embodiment.

In FIG. 16-FIG. 21, pixel layouts are illustrated by a unit of main process steps. First, FIG. 16 shows the pixel layout of a stage where the process up to patterning of a semiconductor layer 201 is completed.

Figure 17:
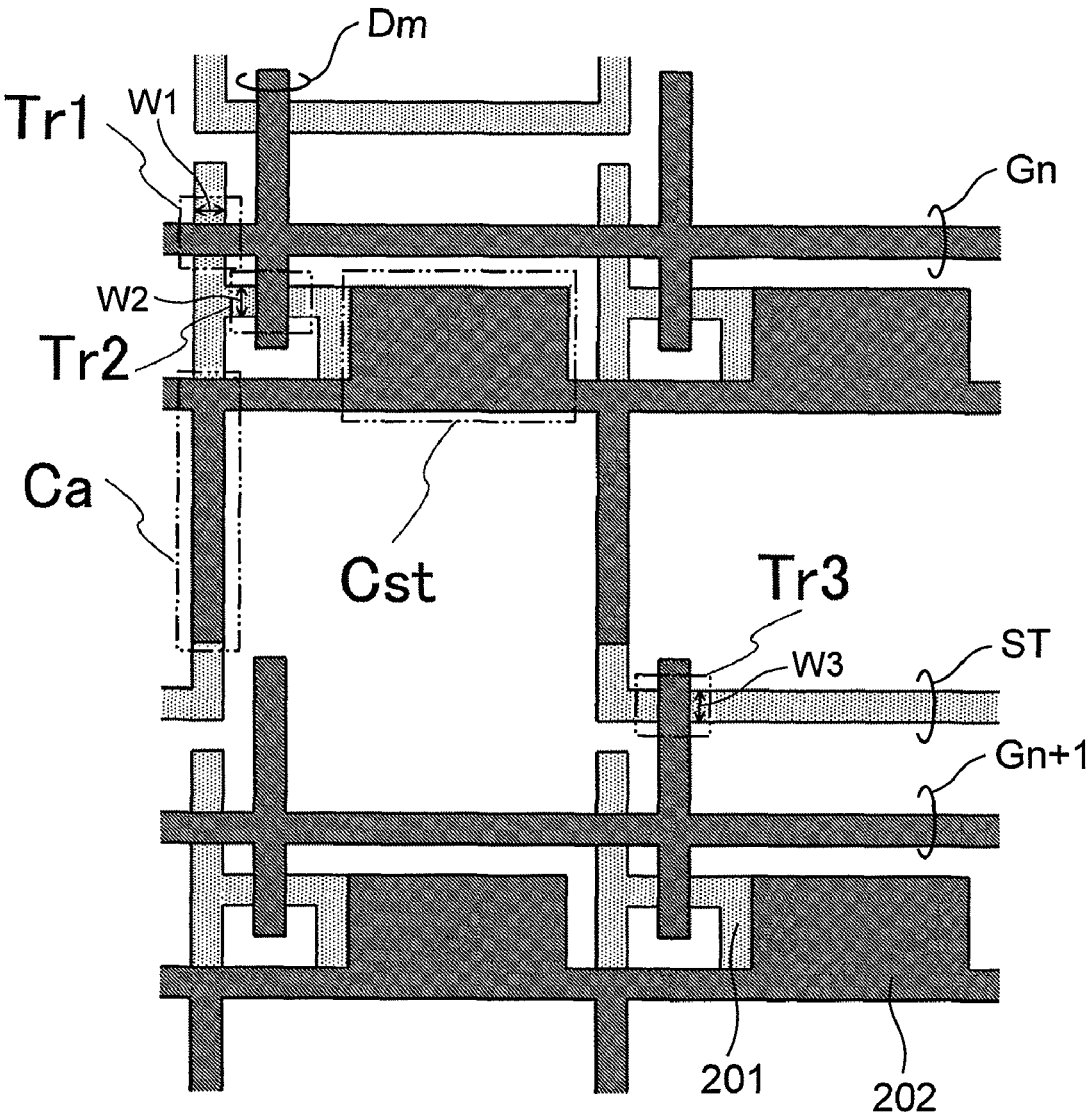
FIG. 17 is a plan view showing an example (b) of the method for manufacturing the pixel matrix and the liquid crystal display device according to the fourth exemplary embodiment.

FIG. 17 shows the pixel layout after patterning of a gate metal layer 202 is completed. The parts surrounded by alternate long and two dash lines indicated by Tr1-Tr3 in the drawing are the part corresponding to the pixel transistors Tr1-Tr3 of each of the pixels 60A, 60B in the pixel matrix 71 and the liquid crystal display device 70 shown in FIG. 8. Similarly, the parts surrounded by alternate long and two dash lines indicated by Cst and Ca are the parts to be the holding capacitor Cst and the control capacitor Ca.

Figure 18:
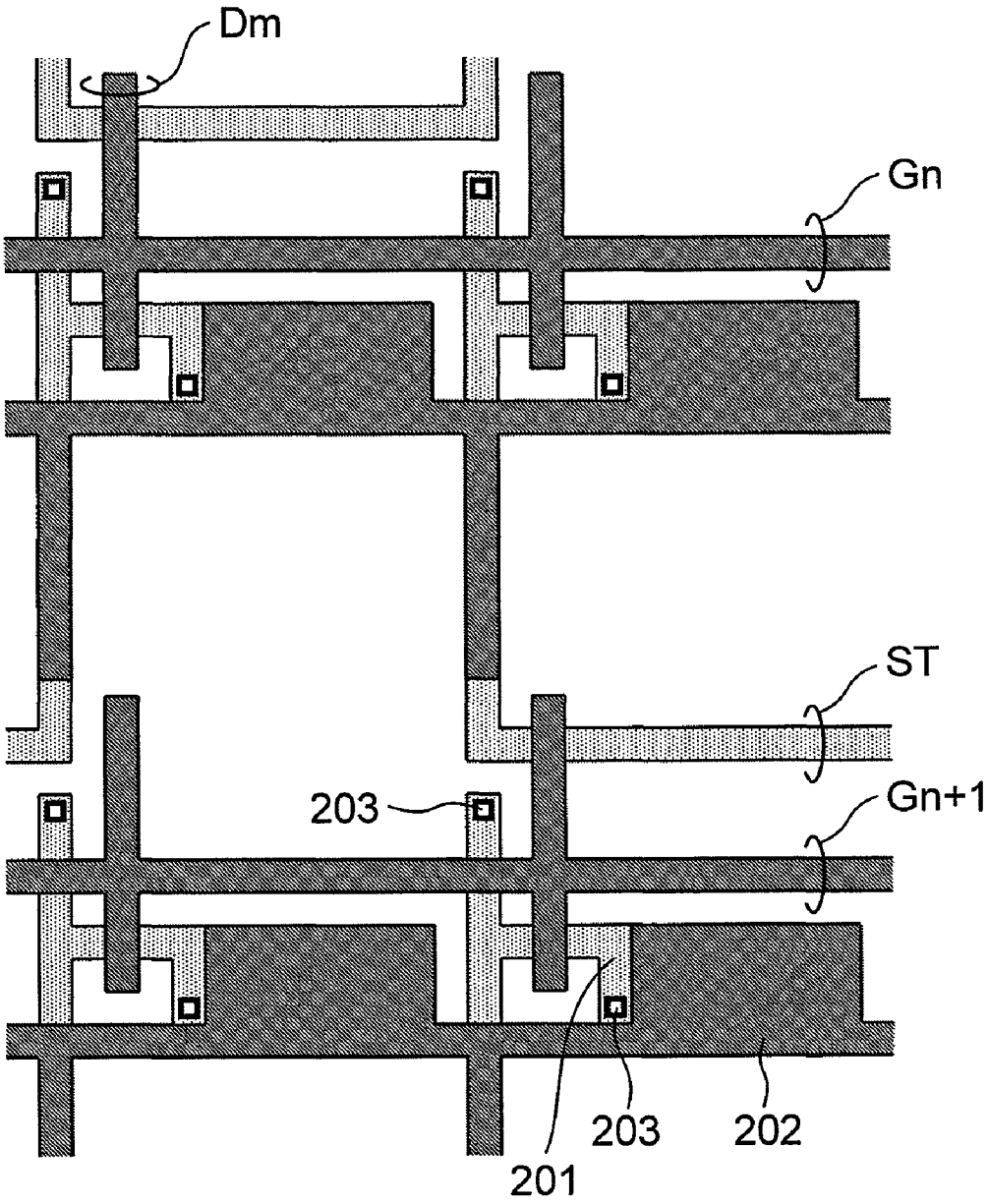
FIG. 18 is a plan view showing an example (c) of the method for manufacturing the pixel matrix and the liquid crystal display device according to the fourth exemplary embodiment.

FIG. 18 shows the layout after a contact hole 203 for electrically connecting a data line metal layer (will be described) and the semiconductor layer 201 or a gate metal layer 202 is formed.

Figure 19:
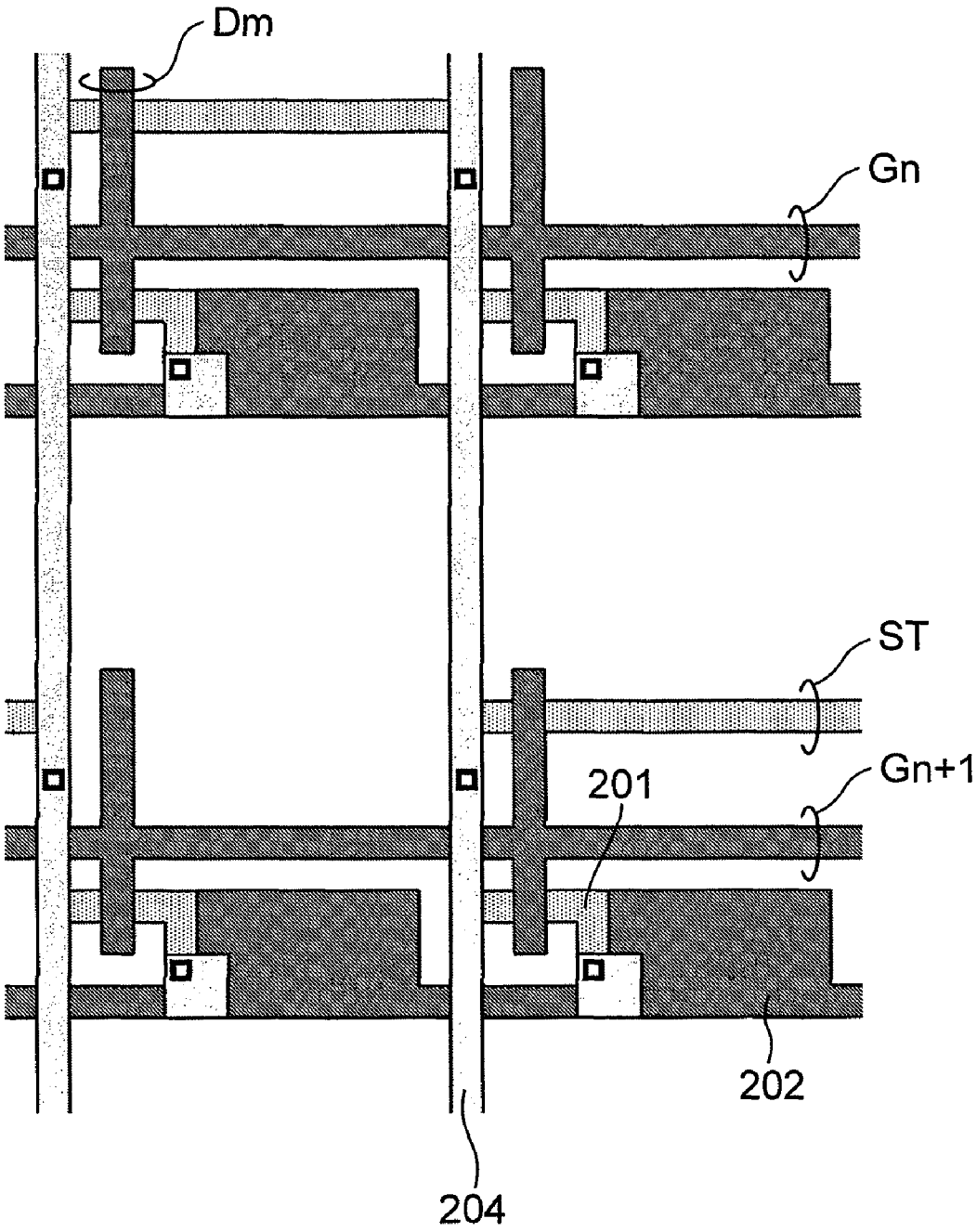
FIG. 19 is a plan view showing an example (d) of the method for manufacturing the pixel matrix and the liquid crystal display device according to the fourth exemplary embodiment.

FIG. 19 shows the pixel layout after patterning of the data line metal layer 204 is completed.

Figure 20:
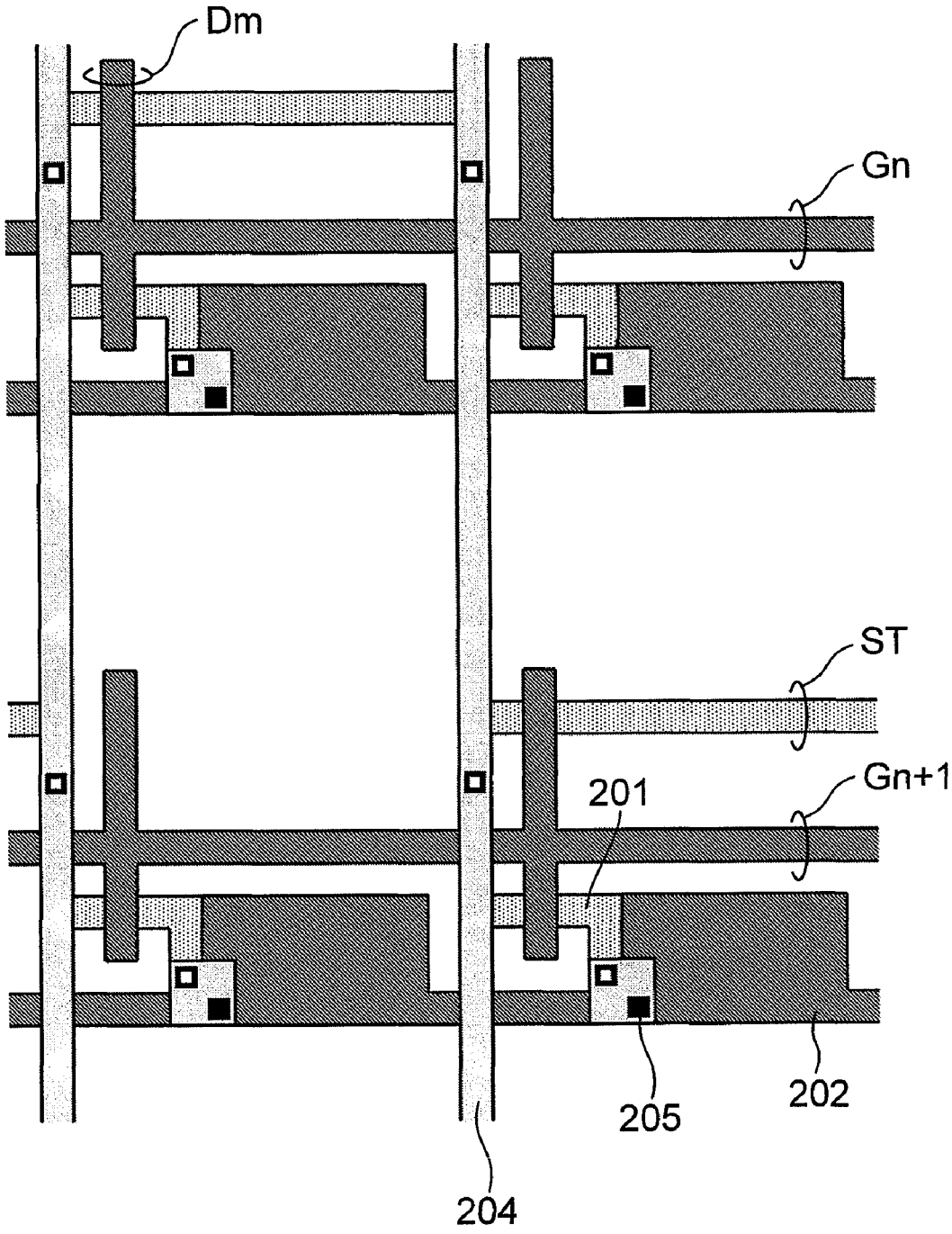
FIG. 20 is a plan view showing an example (e) of the method for manufacturing the pixel matrix and the liquid crystal display device according to the fourth exemplary embodiment.

FIG. 20 shows the layout after a contact hole 205 for electrically connecting the data line metal layer 204 and a pixel electrode metal layer (will be described later) is formed.

Figure 21:
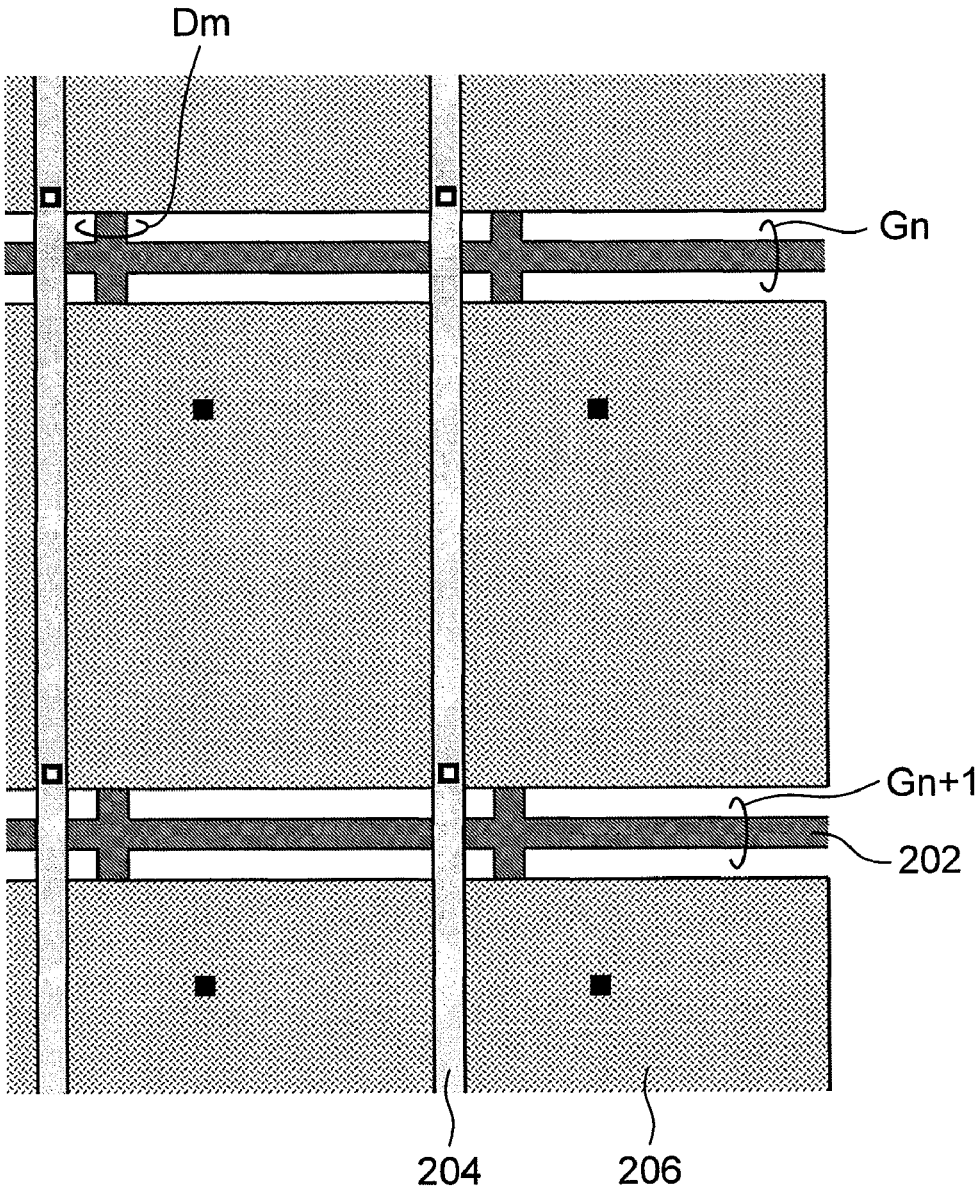
FIG. 21 is a plan view showing an example (f) of the method for manufacturing the pixel matrix and the liquid crystal display device according to the fourth exemplary embodiment.
Figure 22:
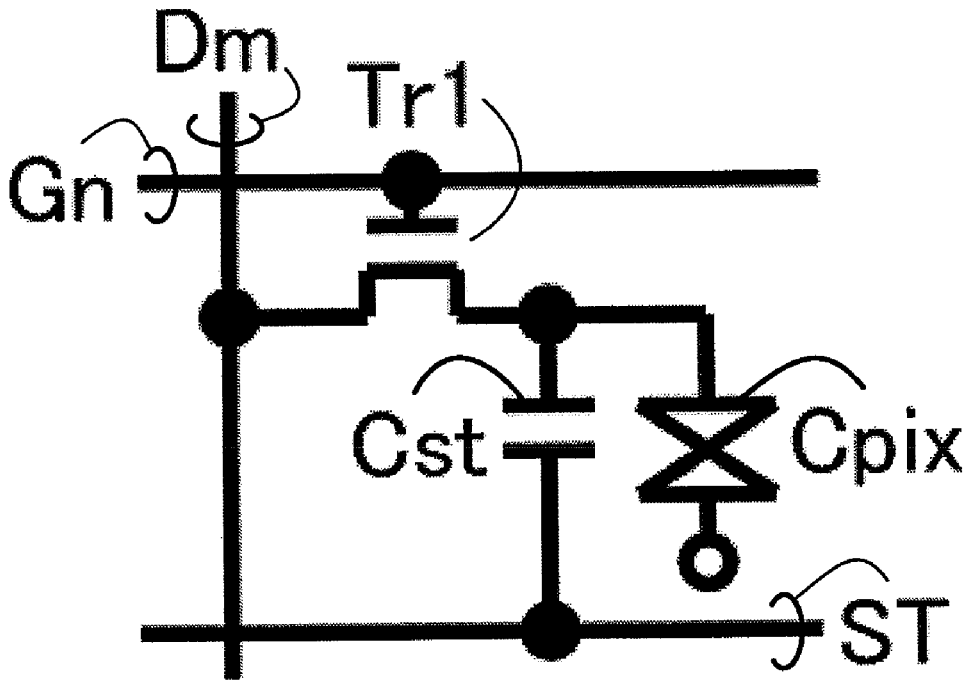
FIG. 22 is a circuit block diagram showing an equivalent circuit for one pixel of a liquid crystal display device using poly-Si TFT.
Figure 23A:
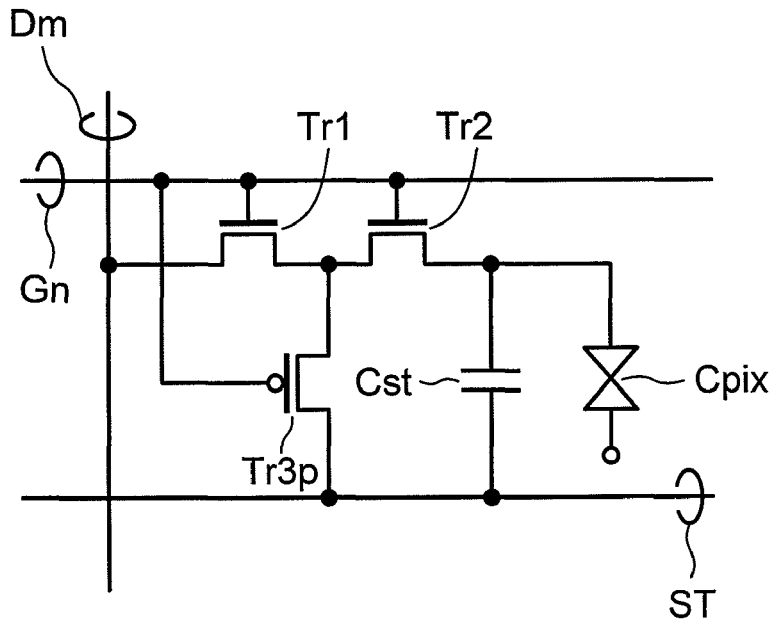
FIG. 23A is a circuit block diagram showing an equivalent circuit for one pixel of the liquid crystal display device disclosed in Patent Document 1.
Figure 23B:
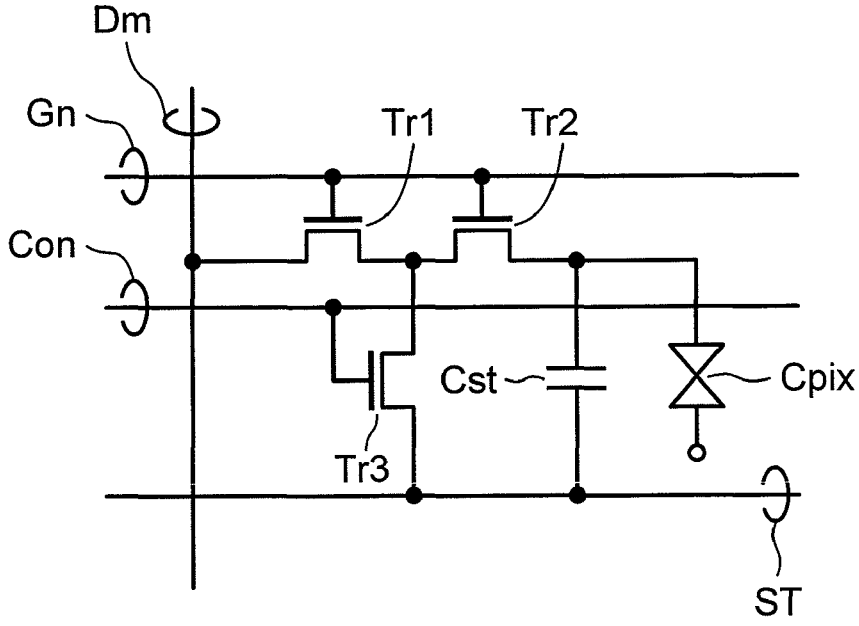
FIG. 23B is a circuit block diagram showing an equivalent circuit for one pixel of the liquid crystal display device disclosed in Patent Document 2.

FIG. 21 shows the pixel layout after patterning of the pixel electrode metal layer 206 is completed.

Through the steps described above, the TFT substrate having the structure described in the fourth exemplary embodiment can be fabricated. It is possible to fabricate the liquid crystal display device by laminating the TFT substrate and the counter substrate having the counter electrode formed thereon, and by inserting liquid crystals to the gap therebetween. As the materials for the insulating film and the metal film, those described above may be used, for example.

Here, processes that are substantially irrelevant to the present invention, such as a process for aligning the liquid crystals, a process for laminating the substrates, and a process for laminating an optical film such as a polarizing plate, are not described. For those processes, it is possible to select the processes suited for the usage of the liquid crystal display device. Further, the pixel matrixes and the liquid crystal display devices according to the other exemplary embodiments can also be fabricated with the same method.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A liquid crystal display device comprising a pixel matrix configured with pixels, each having pixel electrode, which are provided near intersection points of a plurality of gate lines and a plurality of data lines, wherein each of the pixels comprises:

a first switch device having a plurality of transistors A connected in series, for applying a voltage supplied from one of the plurality of data lines to the pixel electrode when the plurality of transistors A are set ON simultaneously, when selected by a first gate line that is one of the plurality of gate lines; and a second switch device having a transistor B and a capacitor, for supplying a prescribed potential at least to one of connection points between the plurality of transistors A and stores the prescribed potential at the capacitor when the transistor B is set ON, when selected by a second gate line that is one of the plurality of gate lines but different from the first gate line, and keeping at least one of potentials of the connection points at the capacitor between the plurality of transistors A, when not selected by the first gate line and the second gate line.

2. The liquid crystal display device as claimed in claim 1, wherein:

each of the pixels comprises a common electrode to which the prescribed potential is applied; and the transistor B is set ON when selected by the second gate line, and supplies the prescribed potential to the capacitor by connecting the common electrode to the capacitor.

3. The liquid crystal display device as claimed in claim 2, wherein:

the first switch comprises a first and a second transistors as the plurality of transistors A, wherein gate electrodes of the first and second transistors are connected in common to the first gate line, either a source electrode or a drain electrode of the first transistor is connected either to a source electrode or a drain electrode of the second transistor, the other one of the source electrode and the drain electrode of the first transistor is connected to one of the data lines, and the other one of the source electrode and the drain electrode of the second transistor is connected to the pixel electrode; and the second switch comprises a third transistor as the transistor B, wherein the capacitor is connected between the connection point of the first and second transistors and the common electrode, a gate electrode of the third transistor is connected to the second gate line, either a source electrode or a drain electrode of the third transistor is connected to the connection point, and the other one of the source electrode and the drain electrode of the third transistor is connected to the common electrode.

4. The liquid crystal display device as claimed in claim 3, wherein at least either the first or the second transistor is formed to have multiple gates.

5. The liquid crystal display device as claimed in claim 3, wherein the first, the second, and the third transistors are of a same conduction type.

6. The liquid crystal display device as claimed in claim 3, wherein the common electrode is divided into a first and a second common electrodes which do not electrically influence each other, the capacitor is connected between the connection point and the first common electrode, and the other one of the source electrode and the drain electrode of the third transistor is connected to the second common electrode.

7. The liquid crystal display device as claimed in claim 3, wherein channel width of the third transistor is smaller than channel width of the first and second transistors.

8. A liquid crystal display device comprising a pixel matrix configured with pixels, each having pixel electrode, which are provided near intersection points of a plurality of gate lines and a plurality of data lines, wherein each of the pixels comprises:

a first switch means having a plurality of transistors A connected in series, for applying a voltage supplied from one of the plurality of data lines to the pixel electrode when the plurality of transistors A are set ON simultaneously, when selected by a first gate line that is one of the plurality of gate lines; and a second switch means having a transistor B and a capacitor, for supplying a prescribed potential at least to one of connection points between the plurality of transistors A and stores the prescribed potential at the capacitor when the transistor B is set ON, when selected by a second gate line that is one of the plurality of gate lines but different from the first gate line, and keeping at least one of potentials of the connection points at the capacitor between the plurality of transistors A, when not selected by the first gate line and the second gate line.

9. A liquid crystal display device comprising a pixel matrix configured with pixels, each having pixel electrode, which are provided near intersection points of a plurality of gate lines and a plurality of data lines, wherein:

each of the pixels comprises a first switch device having a plurality of transistors A connected in series, for applying a voltage supplied from one of the plurality of data lines to the pixel electrode when the plurality of transistors A are set ON simultaneously when selected by a first gate line that is one of the plurality of gate lines; and two neighboring pixels as a pair on the pixel matrix comprise at least one transistor B having its source electrode and drain electrode connected between at least one of connection points of the plurality of transistors A of one pixel and another connection point or at least one connection point of the plurality of transistors A of one pixel and having its gate electrode connected to a second gate line that is one of the plurality of gate lines but different from the first gate line, and comprise a plurality of capacitors having their one ends connected to each of the connection points of the plurality of transistors A of each of the pixels that are connected to the transistor B and having the other ends connected to a common electrode.

10. The liquid crystal display device as claimed in claim 9, wherein:

each of the pixels comprises a counter electrode provided on a same substrate where the pixel electrode is provided or on a separate substrate;

liquid crystals of each of the pixels are controlled by an electric field between the pixel electrode and the counter electrode; and in two of the pixels having at least one of the connection points between the transistors A connected via the transistor B, the counter electrodes thereof have a same potential, and polarities of signals applied to each pixel electrode of the two pixels for the counter electrodes are different.

11. The liquid crystal display device as claimed in claim 9, wherein:

the first switch comprises a first and a second transistors as the plurality of transistors A, wherein gate electrodes of the first and second transistors are connected in common to the first gate line, either a source electrode or a drain electrode of the first transistor is connected either to a source electrode or a drain electrode of the second transistor, the other one of the source electrode and the drain electrode of the first transistor is connected to one of the data lines, and the other one of the source electrode and the drain electrode of the second transistor is connected to the pixel electrode; and one of the two neighboring pixels on the pixel matrix comprises a third transistor as the transistor B, wherein the capacitor is connected between the connection points of the first and second transistors and the common electrode, a gate electrode of the third transistor is connected to the second gate line, either a source electrode or a drain electrode of the third transistor is connected to the connection point between the first and second transistors of one pixel, and the other one of the source electrode and the drain electrode of the third transistor is connected to the connection point between the first and second transistors of another pixel.

12. The liquid crystal display device as claimed in claim 11, wherein at least either the first or the second transistor is formed to have multiple gates.

13. The liquid crystal display device as claimed in claim 11, wherein the first, the second, and the third transistors are of a same conduction type.

14. The liquid crystal display device as claimed in claim 11, wherein channel width of the third transistor is smaller than channel width of the first and second transistors.

15. A liquid crystal display device comprising a pixel matrix configured with pixels, each having pixel electrode, which are provided near intersection points of a plurality of gate lines and a plurality of data lines, wherein:

each of the pixels comprises a first switch means having a plurality of transistors A connected in series, for applying a voltage supplied from one of the plurality of data lines to the pixel electrode when the plurality of transistors A are set ON simultaneously when selected by a first gate line that is one of the plurality of gate lines; and two neighboring pixels as a pair on the pixel matrix comprise at least one transistor B having its source electrode and drain electrode connected between at least one of connection points of the plurality of transistors A of one pixel and another connection point or at least one connection point of the plurality of transistors A of one pixel and having its gate electrode connected to a second gate line that is one of the plurality of gate lines but different from the first gate line, and comprise a plurality of capacitors having their one ends connected to each of the connection points of the plurality of transistors A of each of the pixels that are connected to the transistor B and having the other ends connected to a common electrode.

* * * * *